US008540336B2

(12) United States Patent
Kurata et al.

(10) Patent No.: US 8,540,336 B2
(45) Date of Patent: Sep. 24, 2013

(54) APPARATUS AND METHOD FOR CONTROLLING INK SUPPLY AMOUNT/REGISTRATION ADJUSTMENT IN PRINTING PRESS

(75) Inventors: Yoshiaki Kurata, Ibaraki (JP); Koji Okasaka, Ibaraki (JP); Tomoyuki Morono, Ibaraki (JP); Megumi Kikuchi, Ibaraki (JP)

(73) Assignee: Komori Corporation, Tokyo (JP)

( * ) Notice: Subject to any disclaimer, the term of this patent is extended or adjusted under 35 U.S.C. 154(b) by 97 days.

(21) Appl. No.: 13/253,004

(22) Filed: Oct. 4, 2011

(65) Prior Publication Data

US 2012/0194593 A1 Aug. 2, 2012

(30) Foreign Application Priority Data

Oct. 8, 2010 (JP) ..... 228488/2010

(51) Int. Cl.
*B41J 29/38* (2006.01)
*B41J 2/205* (2006.01)
*B41J 29/393* (2006.01)

(52) U.S. Cl.
USPC ..... 347/19; 347/14; 347/15; 347/16

(58) Field of Classification Search
USPC ..... 347/5, 8, 14–16, 19–20
See application file for complete search history.

(56) References Cited

U.S. PATENT DOCUMENTS

| | | | | |
|---|---|---|---|---|
| 5,992,318 | A | 11/1999 | DiBello et al. | |
| 8,132,887 | B2 * | 3/2012 | Friedman et al. | 347/19 |
| 2008/0266348 | A1 * | 10/2008 | Seki et al. | 347/19 |

FOREIGN PATENT DOCUMENTS

| | | |
|---|---|---|
| EP | 1398154 | 3/2004 |
| EP | 1762389 | 3/2007 |
| JP | S62-099149 A | 5/1987 |
| JP | H08-043205 A | 2/1996 |

* cited by examiner

*Primary Examiner* — Jason Uhlenhake
(74) *Attorney, Agent, or Firm* — Blakely Sokoloff Taylor & Zafman

(57) ABSTRACT

This invention discloses an apparatus for controlling ink supply amount/registration adjustment in a printing press. The apparatus includes a base, sensor head, sensor head moving unit, first detector, second detector, and control unit. The sensor head moving unit includes a upward/downward position adjusting unit which adjusts the upward/downward position of the sensor head. The second detector detects the upward/downward position of a color bar when color matching data of a color patch of each color in the color bar is measured by the first detector. The upward/downward position adjusting unit adjusts the upward/downward position of the sensor head based on the upward/downward position of the color bar, which is detected by the second detector. A method of controlling ink supply amount/registration adjustment in a printing press is also disclosed.

12 Claims, 18 Drawing Sheets

APPARATUS AND METHOD FOR CONTROLLING INK SUPPLY AMOUNT/REGISTRATION ADJUSTMENT IN PRINTING PRESS

BACKGROUND OF THE INVENTION

The present invention relates to an apparatus and method for controlling ink supply amount/registration adjustment in a printing press, which simultaneously perform ink supply amount adjustment (color tone adjustment) and registration adjustment of each color in a printing press.

Conventionally, not only an image is printed on a printing product printed by a printing press but also a color bar including color patches used to measure the densities of respective colors is printed in the top, bottom, or center margin of the printing product to extend laterally. The density of the printed color patch of each color is automatically measured by laterally moving an automatic scanning colorimeter. The density value of the measured color patch of each color is compared with a reference density value for this color to adjust the opening ratio of an ink fountain key of this color in accordance with the difference between these density values. Thus, the printing product is printed using a reference density value for each color. Note that instead of the density value, the color value may be measured. In this case, the printing product is printed using a reference color value for each color.

However, in measuring the color bar on the printed printing product using an automatic scanning colorimeter, the color bar must precisely be placed below the scanning path of the colorimeter. That is, the printing product must precisely be placed on a base on which the colorimeter is mounted to be movable in the X direction (the lateral direction; a direction perpendicular to the conveyance/printing direction) and the Y direction (the upward/downward direction; the conveyance/printing direction or circumferential direction regarding a cylinder), thus inflicting a heavy burden on the operator.

To solve this problem, a scanning apparatus which manipulates the color bar using a colorimeter including a line sensor with a upward/downward dimension larger than the width (upward/downward dimension) of the color bar is proposed, as disclosed in Japanese patent Laid-Open No. 8-043205 (literature 1). Literature 1 adopts a measurement scheme of detecting the central position of the color bar in the upward/downward direction using the line sensor to adjust the upward/downward position of the colorimeter in accordance with the detected central position. Using such a measurement scheme, the density value or color value of the color patch of each color in the color bar can precisely be measured as color matching data even if the printing product is not precisely placed on the base.

On the other hand, a register mark of each color used to adjust registration of this color is printed in the margin of the printing product printed by the printing press. According to Japanese Patent Laid-Open No. 62-99149, a cruciform register mark printed at a predetermined position for each color is captured by a camera to obtain the amount of positional shift of an image of each color based on a shift between a reference position and the position of the intersection point of the captured register mark for each color. The position of a plate cylinder of each color, which holds a printing plate of this color, and the position, in the skewing direction, of a transfer cylinder for printing paper conveyance, are adjusted as registration error amounts in accordance with the obtained amount of positional shift to match the position of the image of this color with the target position.

However, it is a conventional practice to provide the printing press with separate adjusting devices: an ink supply amount adjusting device which uses a color bar, and a registration adjusting device which uses register marks. The ink supply amount adjusting device includes a sensor for measuring color matching data of each patch, and a line sensor for detecting the upward/downward position of the color bar. On the other hand, the registration adjusting device includes a camera for detecting the positions of the register marks. Thus, the entire printing press entails a high cost. Also, the two devices require individual maintenance, thus inflicting a heavy burden on the operator.

SUMMARY OF THE INVENTION

It is an object of the present invention to provide an apparatus and method for controlling ink supply amount/registration adjustment in a printing press, which reduce the cost of the entire printing press.

It is another object of the present invention to provide an apparatus and method for controlling ink supply amount/registration adjustment in a printing press, which simplify maintenance to relieve the operator's burden.

In order to achieve the above-described objects, according to an aspect of the present invention, there is provided an apparatus for controlling ink supply amount/registration adjustment in a printing press, including a base on which a printing product printed by the printing press is set, a sensor head, sensor head moving means for moving the sensor head laterally and upward/downward on the base, a first detector which is mounted on the sensor head, and measures color matching data of a color patch of each color in a color bar printed in a margin of the printing product, a second detector which detects a position of a register mark of each color, which is printed in a margin of the printing product, and control means for, when the sensor head moves laterally, controlling an ink supply amount of each color in the printing press based on the color matching data of the color patch of each color in the color bar, which is measured by the first detector, and adjusting registration of each color in the printing press based on the position of the register mark of each color, which is measured by the second detector, the sensor head moving means comprising upward/downward position adjusting means for adjusting a upward/downward position of the sensor head, wherein the second detector detects a upward/downward position of the color bar when the color matching data of the color patch of each color in the color bar is measured by the first detector, and the upward/downward position adjusting means adjusts the upward/downward position of the sensor head based on the upward/downward position of the color bar, which is detected by the second detector.

According to another aspect of the present invention, there is provided a method of controlling ink supply amount/registration adjustment in a printing press, comprising the steps of measuring color matching data of a color patch of each color in a color bar, which is printed in a margin of a printing product, using a first detector mounted on a sensor head, detecting a upward/downward position of the color bar using a second detector upon defining a moving direction of the sensor head as a measuring direction when the color matching data of the color patch of each color in the color bar is measured by the first detector, adjusting a upward/downward position of the sensor head based on the upward/downward position of the color bar, which is detected by the second detector, controlling an ink supply amount of each color in the printing press based on the color matching data of the color patch of each color in the color bar, which is measured by the first detector, when the sensor head moves laterally, detecting a position of a register mark of each color, which is printed in a margin of the printing product, using the second detector, and adjusting registration of each color in the printing press based on the position of the register mark of each color, which is measured by the second detector.

In the present invention, a spectroscopic sensor, for example, is used as the first detector, and an image sensor, for example, is used as the second detector. In this case, the spectroscopic sensor and the image sensor are mounted on the sensor head, and the image sensor exhibits the same function as the conventional line sensor, which is required to detect the upward/downward position of the color bar, during measurement of color matching data of the color patch of each color in the color bar. Also, the image sensor exhibits the same function as the conventional camera, which is required to adjust registration, at the position at which the register mark of each color is detected.

Note that in the present invention, when a spectroscopic sensor, for example, is used as the first detector, the color matching data includes, for example, color data measured by the spectroscopic sensor, and the density value or color value obtained from this color data. Alternatively, the density value directly measured by a densitometer which uses a filter may be used as the color matching data. In this manner, the color matching data represents a superordinate concept including all data with which density adjustment or color adjustment (color matching) can be done based on the data.

Also, in the present invention, adjusting registration of each color in the printing press means adjusting the position of a plate cylinder of each color, which holds a printing plate of this color, or adjusting the position, in the skewing direction, of a transfer cylinder which conveys a printing sheet.

DESCRIPTION OF THE PREFERRED EMBODIMENT

An apparatus for controlling ink supply amount/registration adjustment according to an embodiment of the present invention will be described in detail below with reference to the accompanying drawings.

[Inking Devices]

Figure 1:
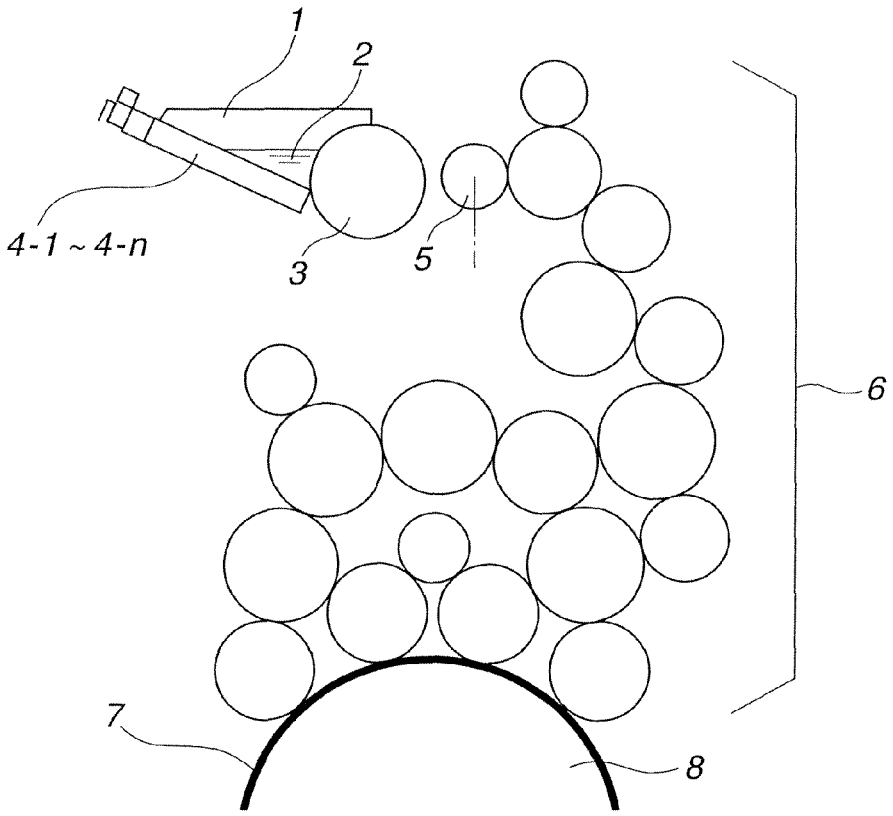
FIG. 1 is a view showing the main part of an inking device (inker) of each color, which is provided in a corresponding one of a plurality of printing units which constitute a printing press to which the present invention is applied.

An inking device (inker) of a printing unit of each color, which constitutes a printing press for four-color printing shown in FIG. 1, includes an ink fountain 1, ink 2 stored in the ink fountain 1, an ink fountain roller 3, a plurality of ink fountain keys 4-1 to 4-n juxtaposed in the axial direction of the ink fountain roller 3, an ink ductor roller 5, an ink roller group 6, and a printing plate 7 mounted on a plate cylinder 8. An image is printed on the printing plate 7.

[Printing Product]

Figure 2:
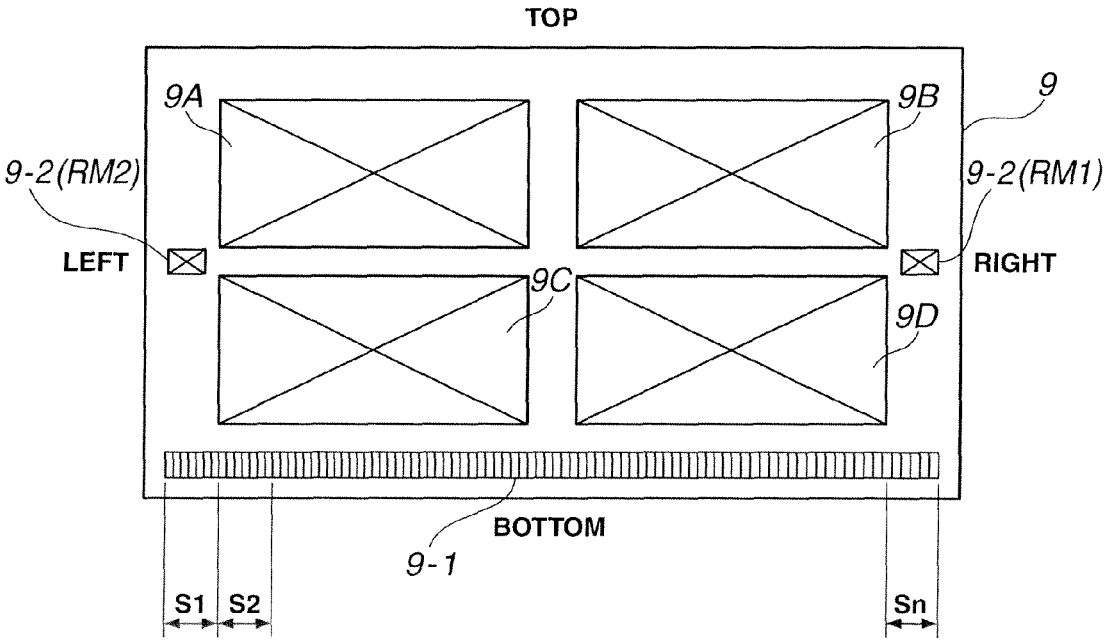
FIG. 2 is a plan view showing a printing product printed by the printing press shown in FIG. 1.

In the above-mentioned inking device, the ink 2 in the ink fountain 1 is supplied from the gap between the ink fountain keys 4-1 to 4-n and the ink fountain roller 3. The ink 2 supplied to the ink fountain roller 3 is further supplied to the printing plate 7 via the ink roller group 6 by the ink feed operation of the ink ductor roller 5. The ink 2 supplied to the printing plate 7 is printed on a printing sheet via a blanket cylinder (not shown) to obtain a printing product 9 shown in FIG. 2.

[Color Bar]

A band-shaped color bar 9-1 is printed in a margin other than image regions 9A to 9D to extend laterally. Although the color bar 9-1 is printed in the bottom margin (lower margin) of the printing product 9 in this example, it may be printed in the top margin (upper margin) or center margin of the printing product 9.

In general four-color printing, the color bar 9-1 is formed by regions S1 to Sn including color patches (solid patches with 100% dot area) used to measure the densities of respective colors: black, cyan, magenta, and yellow. The regions S1 to Sn correspond to the key zones of the ink fountain keys 4-1 to 4-n in the printing unit of each color in the printing press.

[Register Marks]

Register marks 9-2 are printed in margins other than the color bar 9-1 on the printing product 9. In this example, a first register mark RM1 is printed at the right center of the printing product 9, and a second register mark RM2 is printed at the left center of the printing product 9.

Figure 3:
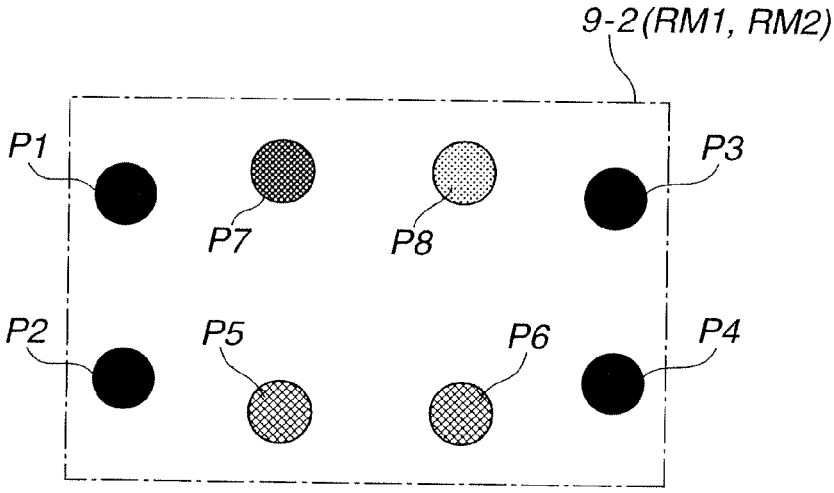
FIG. 3 is a plan view showing a set of register marks printed in the margins of the printing product shown in FIG. 2.

Each of the register marks RM1 and RM2 is formed by four black register marks P1 to P4, two yellow register marks P5 and P6, one magenta register mark P7, and one cyan register mark P8, as shown in FIG. 3. The register marks P1 to P8 are printed in a spot pattern so that they are scattered in the register marks RM1 and RM2. A description of register marks printed in a spot pattern in U.S. Pat. No. 5,018,213 is incorporated in this specification.

[Scanner]

Figure 4:
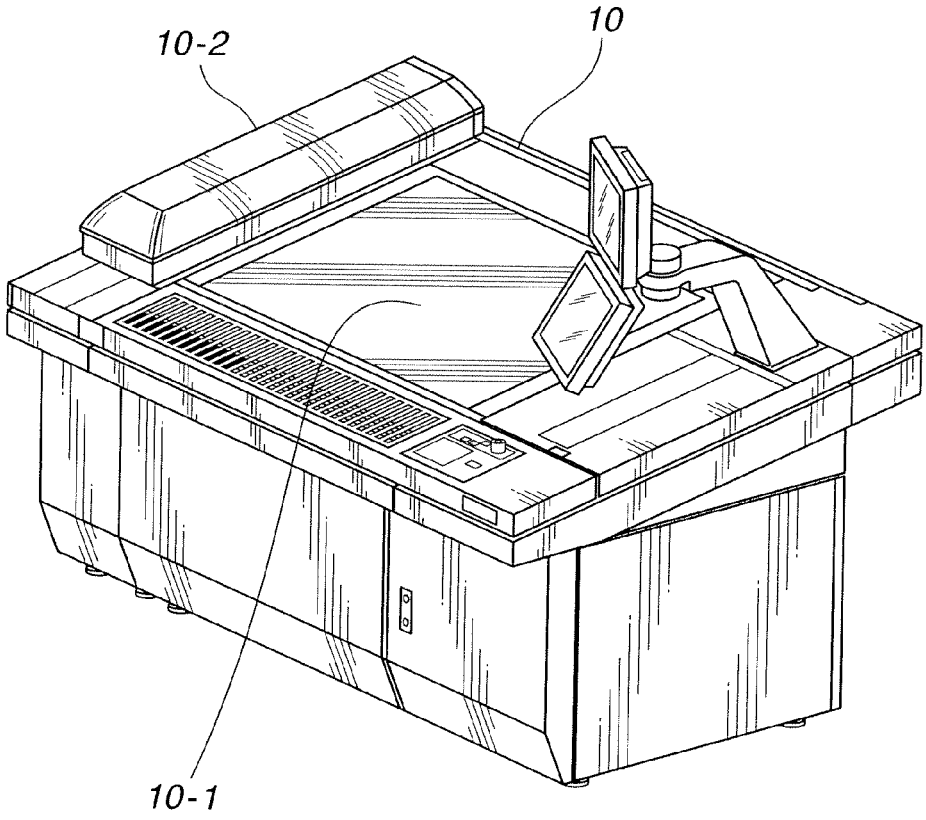
FIG. 4 is a perspective view showing the outer appearance of a scanner which reads the density value of a color patch of each color in a color bar printed on the printing product shown in FIG. 2, and the position of a register mark of each color in the set of register marks printed on this printing product.
Figure 5:
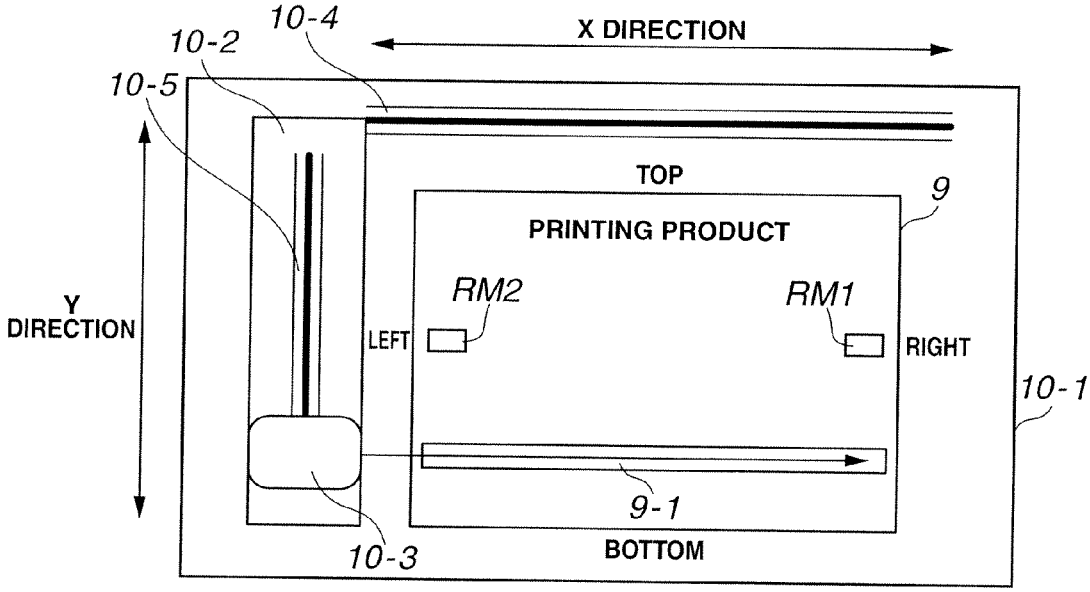
FIG. 5 is a plan view showing the state in which the printing product is set on a base of the scanner shown in FIG. 4, and the moving direction (X and Y directions) of a scanning head which moves on the base.

A scanner 10 includes a base 10-1 having an upper surface on which the printing product 9 is set, and a scanning unit 10-2 which moves on the base 10-1, as shown in FIG. 4. A scanning head (sensor head) 10-3 shown in FIG. 5 is provided in the scanning unit 10-2.

The scanning unit 10-2 moves on the upper surface of the base 10-1 in the X direction (laterally) by an X driving mechanism 10-4. The scanning head 10-3 moves in the scanning unit 10-2 in the Y direction (upward/downward) by a Y driving mechanism 10-5. In this arrangement, the scanning head 10-3 moves on the base 10-1 in the X and Y directions by the X driving mechanism 10-4 and Y driving mechanism 10-5 (sensor head moving means), respectively. The printing product 9 is set on the base 10-1 upon defining the lateral direction (a direction perpendicular to the printing/conveyance direction) as the X direction, and the upward/downward direction (printing/conveyance direction or circumferential direction regarding a cylinder) as the Y direction.

[Scanning Head]

Figure 6:
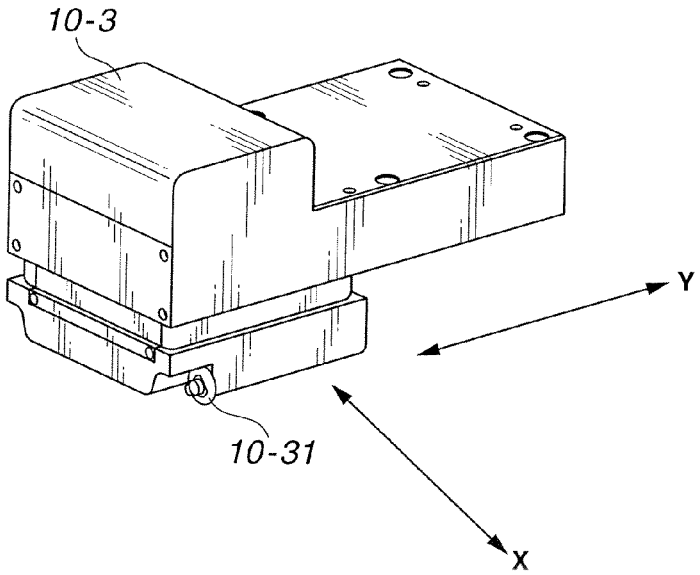
FIG. 6 is a perspective view showing the outer appearance of the scanning head shown in FIG. 5.
Figure 7:
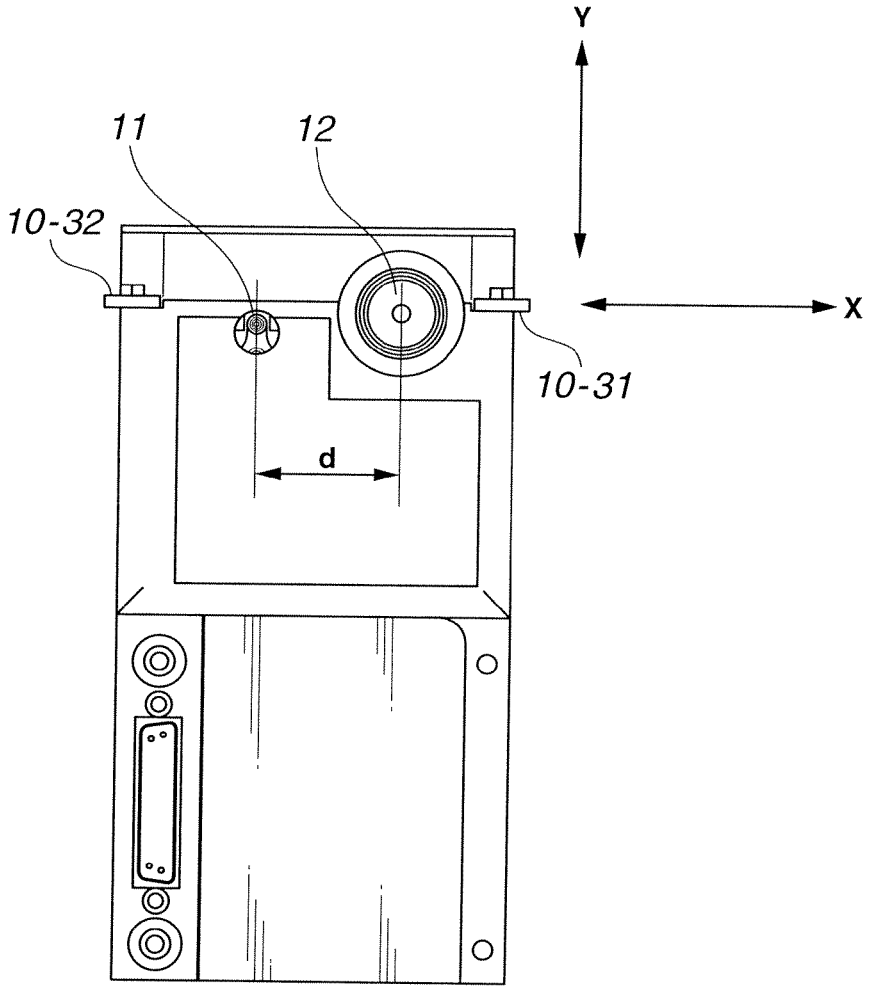
FIG. 7 is a bottom view of the scanning head shown in FIG. 5.

Rollers 10-31 and 10-32 which guide movement in the X direction are provided on the bottom surface of the scanning head 10-3, as shown in FIGS. 6 and 7. In measuring the density value of the color patch of each color in the color bar 9-1 or detecting the positions of the register marks of each color in the register marks 9-2, the scanning head 10-3 is lowered so that the rollers 10-31 and 10-32 land on the upper surface of the base 10-1.

The scanning head 10-3 mounts a spectroscopic sensor 11 and an image sensor 12 which constitutes a color camera. The spectroscopic sensor 11 functions as a detector (first detector) for measuring the density value of the color patch of each color in the color bar 9-1 printed on the printing product 9. The image sensor 12 functions as a detector (second detector) for detecting the positions of the register marks of each color in the register marks 9-2. The image sensor 12 also serves as a detector for detecting the upward/downward position of the color bar 9-1.

Figure 8:
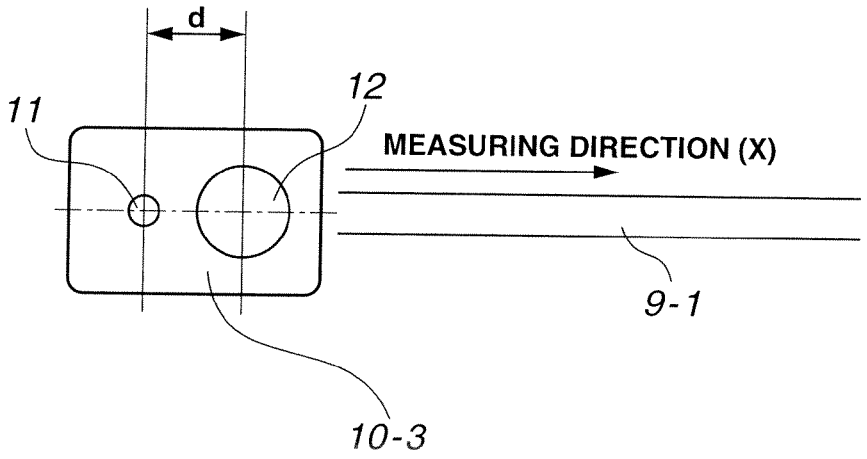
FIG. 8 is a view showing the moving direction (measuring direction) of the scanning head when the density value of the color patch of each color in the color bar printed on the printing product placed on the base of the scanner is measured.

The image sensor 12 has an image sensing region with a upward/downward dimension larger than the width (upward/downward dimension) of the color bar 9-1, and is provided in front of the spectroscopic sensor 11 in the X direction. That is, when the moving direction of the scanning head 10-3 in measuring the density value of the color patch of each color in the color bar 9-1 is defined as the measuring direction (see FIG. 8), the image sensor 12 is mounted on the scanning head 10-3 such that its set position is located downstream of the spectroscopic sensor 11 in the measuring direction. Let d be the distance by which the spectroscopic sensor 11 and the image sensor 12 are spaced apart from each other in the measuring direction.

[Apparatus for Controlling Ink Supply Amount/Registration Adjustment]

Figure 9:
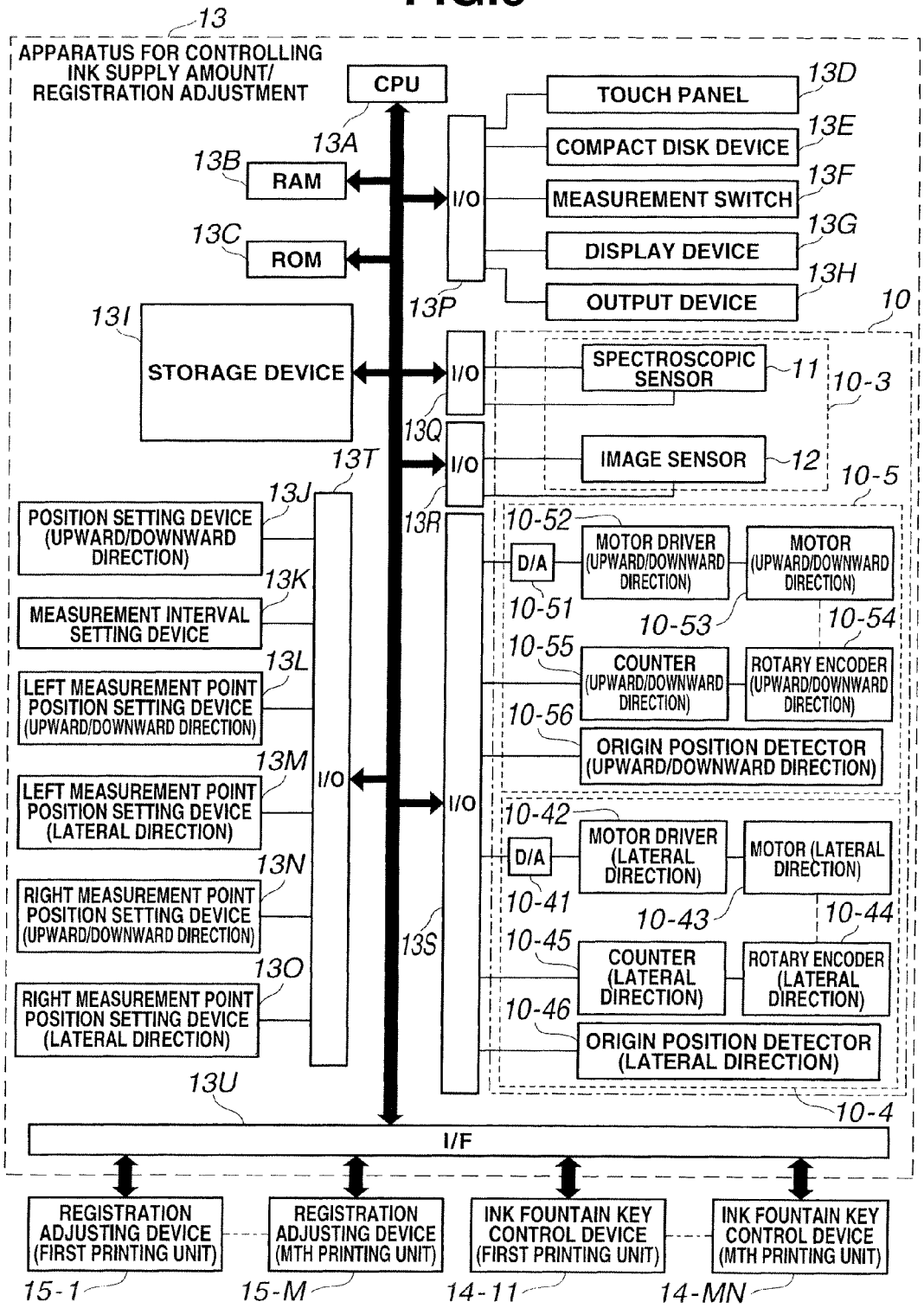
FIG. 9 is a block diagram showing the electrical configuration of an apparatus for controlling ink supply amount/registration adjustment according to an embodiment of the present invention.

An apparatus 13 for controlling ink supply amount/registration adjustment includes not only the above-mentioned scanner 10 but also a CPU 13A, a RAM 13B, a ROM 13C, a touch panel 13D, a compact disk device 13E, a measurement switch 13F, a display device 13G, a flexible disk drive, an output device 13H such as a printer, and a storage unit 13I, as shown in FIG. 9.

The apparatus 13 for controlling ink supply amount/registration adjustment also includes a device 13J for setting the upward/downward position of the color bar 9-1, a device 13K for setting the measurement interval for the color bar 9-1, a device 13L for setting the upward/downward position of a measurement point for the left register mark RM2, a device 13M for setting the lateral position of a measurement point for the left register mark RM2, a device 13N for setting the upward/downward position of a measurement point for the right register mark RM1, a device 13O for setting the lateral position of a measurement point for the right register mark RM1, and input/output interfaces (I/O, I/F) 13P to 13U.

The X driving mechanism 10-4 for the scanner 10 mentioned above includes a D/A converter 10-41, a motor driver 10-42 for laterally moving the scanning head 10-3, a motor 10-43 for laterally moving the scanning head 10-3, a rotary encoder 10-44 for the motor 10-43 for laterally moving the scanning head 10-3, a counter 10-45 for measuring the current lateral position of the scanning head 10-3, and a detector 10-46 for detecting the origin position of the scanning head 10-3 in the lateral direction.

The Y driving mechanism 10-5 for the scanner 10 mentioned above includes a D/A converter 10-51, a motor driver 10-52 for moving upward/downward the scanning head 10-3, a motor 10-53 for moving upward/downward the scanning head 10-3, a rotary encoder 10-54 for the motor 10-53 for moving upward/downward the scanning head 10-3, a counter 10-55 for measuring the current upward/downward position of the scanning head 10-3, and a detector 10-56 for detecting the origin position of the scanning head 10-3 in the upward/downward direction.

The apparatus 13 for controlling ink supply amount/registration adjustment is connected to ink fountain key control devices 14-11 to 14-MN of the printing units of the respective colors, and registration adjusting devices 15-1 to 15-M for adjusting registration of the printing units of the respective colors. Each of the registration adjusting devices 15-1 to 15-M is formed by adjusting devices for the skewing, upward/downward, and lateral directions.

Figure 10A:
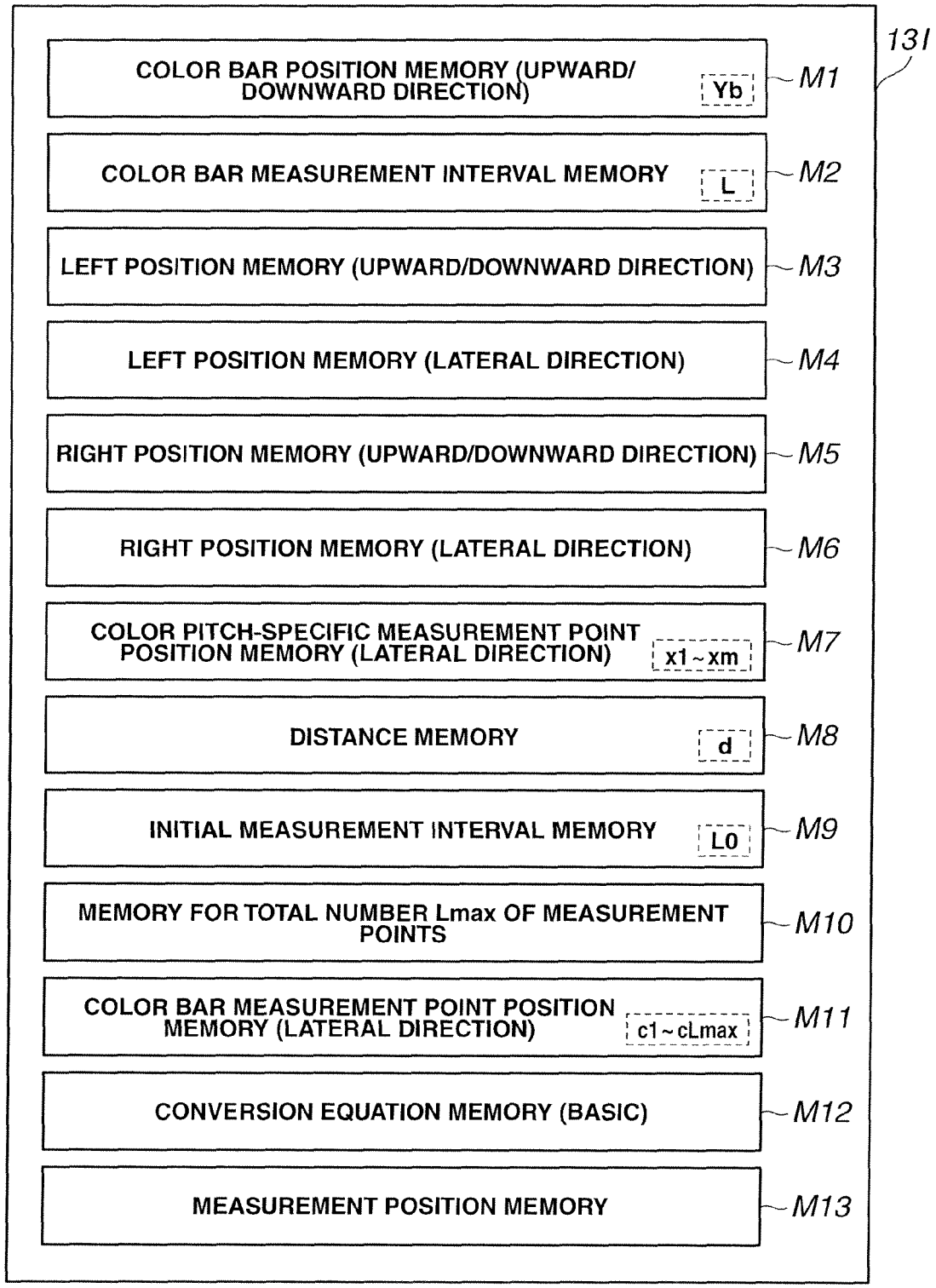
FIGS. 10A and 10B are block diagrams showing details of a storage unit in the apparatus for controlling ink supply amount/registration adjustment shown in FIG. 9.
Figure 10B:
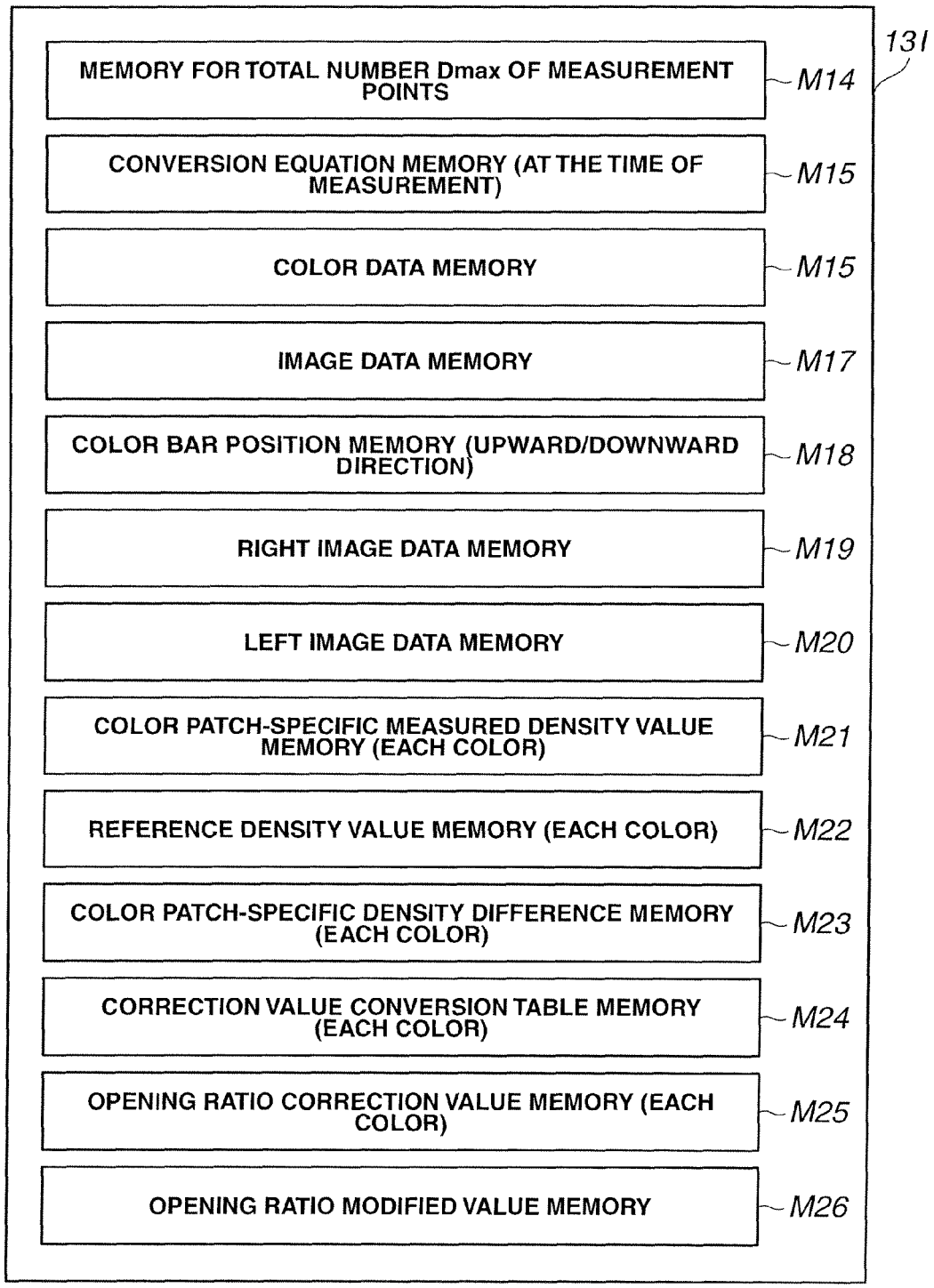

The storage unit 13I includes memories M1 to M26, as shown in FIGS. 10A and 10B. The memory M1 stores a upward/downward position Yb of the color bar 9-1. The memory M2 stores a measurement interval L at which the color bar 9-1 is measured by the image sensor 12. The memory M3 stores the upward/downward position of a measurement point at which the left register mark RM2 is measured by the image sensor 12. The memory M4 stores the lateral position of the measurement point at which the left register mark RM2 is measured by the image sensor 12. The memory M5 stores the upward/downward position of a measurement point at which the right register mark RM1 is measured by the image sensor 12. The memory M6 stores the lateral position of the measurement point at which the right register mark RM1 is measured by the image sensor 12.

The memory M7 stores lateral positions x1 to xm of measurement points at which the color patches of the respective colors are measured by the spectroscopic sensor 11. The memory M8 stores the distance d between the spectroscopic sensor 11 and the image sensor 12. The memory M9 stores an initial measurement interval L0 at which the color bar 9-1 is measured by the image sensor 12. The memory M10 stores the total number Lmax of measurement points at which the color bar 9-1 is measured by the image sensor 12. The memory M11 stores lateral positions c1 to cLmax of measurement points at which the color bar 9-1 is measured by the image sensor 12. The memory M12 stores a basic lateral-to-upward/downward scanning path conversion equation of the color bar 9-1.

The memory M13 stores, as the measurement positions of the scanning head 10-3, the lateral positions x1 to xm of the measurement points for the respective rearranged color patches, and the lateral positions cl to cLmax of measurement points for the color bar 9-1. The memory M14 stores the total number Dmax of measurement points obtained by summing up the number of lateral positions x1 to xm of the measurement points for the respective color patches, and the number of lateral positions cl to cLmax of the measurement points for the color bar 9-1. The memory M15 stores a lateral-to-upward/downward scanning path conversion equation for measurement of the color bar 9-1.

The memory M16 stores color data measured by the spectroscopic sensor 11. The memory M17 stores image data of the color bar 9-1 sensed by the image sensor 12. The memory M18 stores the upward/downward position of the color bar 9-1, which is obtained from the image data of the color bar 9-1 sensed by the image sensor 12. The memory M19 stores image data of the right register mark RM1 sensed by the image sensor 12. The memory M20 stores image data of the left register mark RM2 sensed by the image sensor 12.

The memory M21 stores the measured density value of the color patch of each color, which is calculated from the color data measured by the spectroscopic sensor 11. The memory M22 stores a reference density value for each color. The memory M23 stores the density difference between the measured density value of the color patch of each color and the reference density value of this color. The memory M24 stores a density difference-to-ink fountain key opening ratio correction value conversion table of each color. The memory M25 stores the correction value of the opening ratio of the ink fountain key of each color, which is obtained from the density difference-to-ink fountain key opening ratio correction value conversion table. The memory M26 stores the modified value of the opening ratio of each ink fountain key in the printing unit of each color.

A process operation executed by the CPU 13A of the apparatus 13 for controlling ink supply amount/registration adjustment will be described next with reference to FIGS. 11A to 11C. The CPU 13A obtains various types of input information provided via the interfaces 13P to 13U, and executes a process operation in accordance with the program, stored in the ROM 13C, while accessing the RAM 13B or the storage unit 13I. Note that the contents stored in the memories M1 to M26 shown in FIGS. 10A and 10B will become apparent from the description of the process operation of the CPU 13A.

[Setting of Printing Product on Upper Surface of Base of Scanner]

Figure 12:
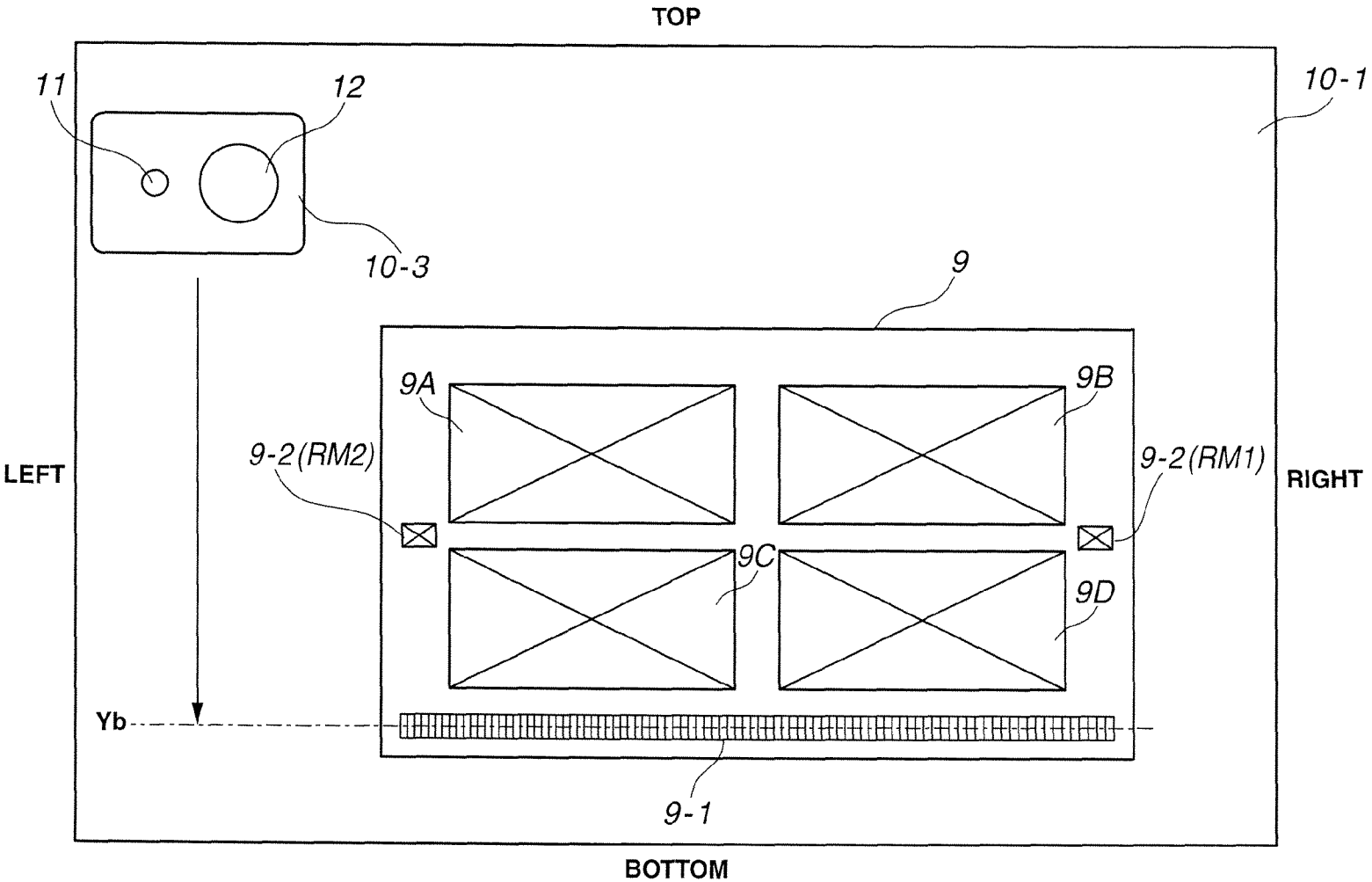
FIG. 12 is a plan view showing the state in which the printing product is precisely placed at a reference set position on the base of the scanner shown in FIG. 4.

At the start of ink supply amount adjustment and registration adjustment in the printing press, the operator sets the printing product 9 on the upper surface of the base 10-1 of the scanner 10, as shown in FIG. 12. At this time, the printing product 9 is set at a reference set position on the base 10-1.

[Data Input]

Figure 11A:
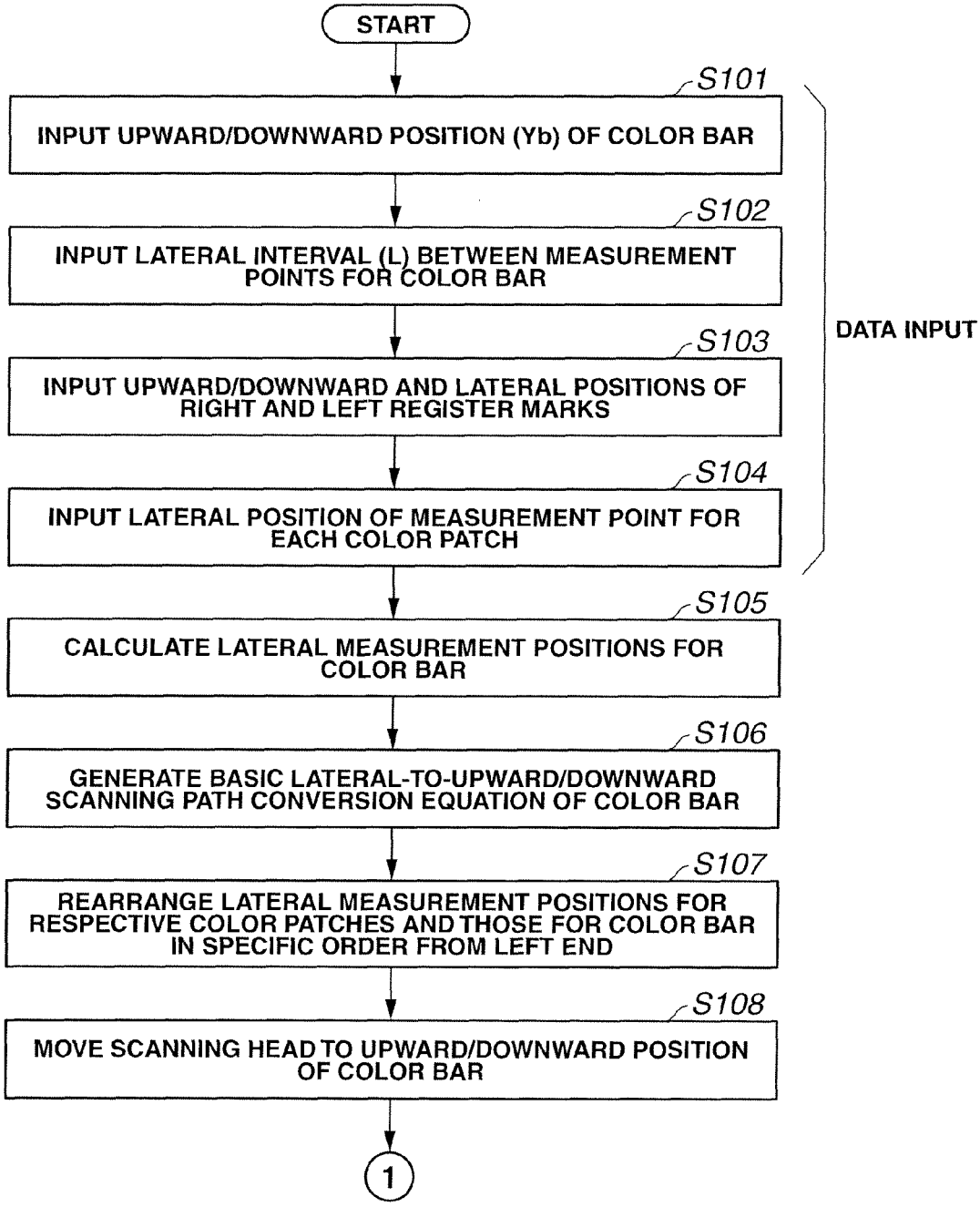
FIGS. 11A to 11C are flowcharts showing a process operation executed by a CPU of the apparatus for controlling ink supply amount/registration adjustment shown in FIG. 9.
Figure 11B:
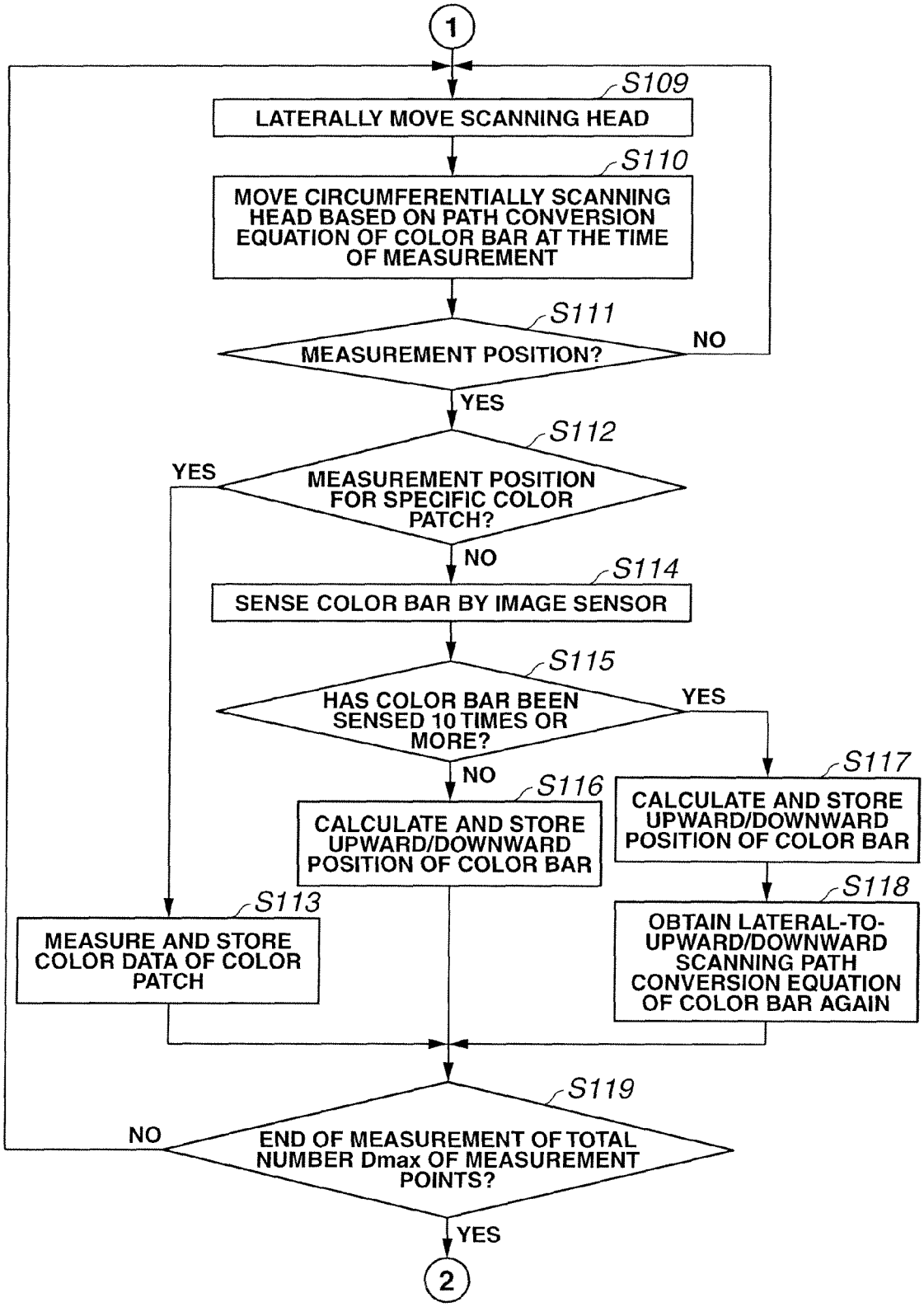
Figure 11C:
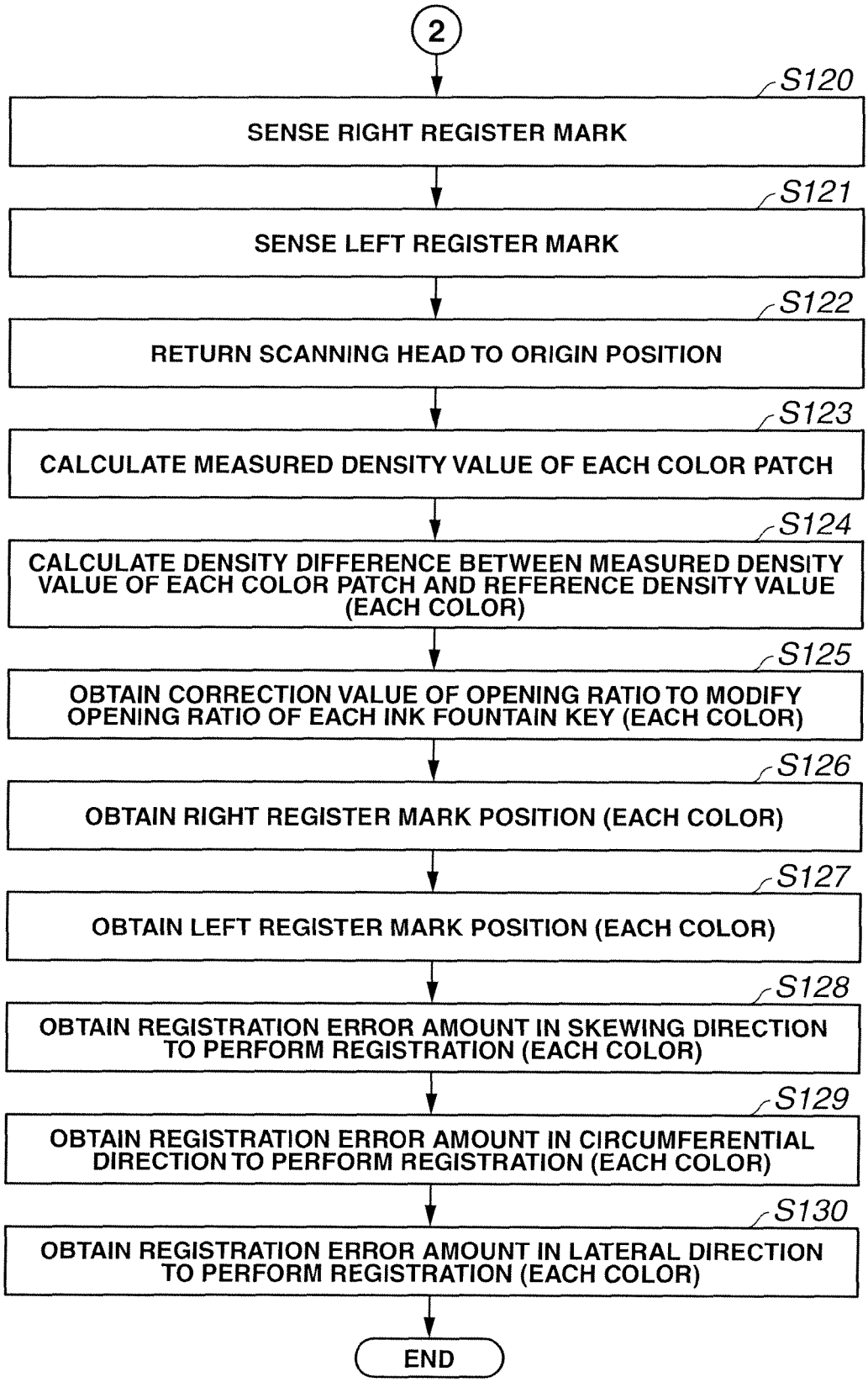

Next, the operator uses the position setting device 13J to input the upward/downward position Yb of the color bar 9-1 on the printing product 9 (step S101 in FIG. 11A). The input upward/downward position Yb of the color bar 9-1 is stored in the memory M1. Note that the upward/downward position Yb of the color bar 9-1 is input as that corresponding to the reference set position of the printing product 9.

The operator uses the measurement interval setting device 13K to input the lateral interval L between the measurement points at which the color bar 9-1 is measured by the image sensor 12 (step S102). The input lateral interval L between the measurement points for the color bar 9-1 is stored in the memory M2. Note that the lateral interval L between the measurement points for the color bar 9-1 is larger than the initial measurement interval L0 stored in the memory M9 in advance (L>L0). That is, the initial measurement interval L0 is set in advance as a measurement interval smaller than the measurement interval L input by the operator.

The operator uses the position setting devices 13L, 13M, 13N, and 13O to input the upward/downward and lateral positions of the right and left register marks 9-2 on the printing product 9 (step S103). The input upward/downward and lateral positions of the right and left register marks 9-2 are stored in the memories M3 to M6. Note that the upward/downward and lateral positions of the right and left register marks 9-2 are input as those corresponding to the reference set position of the printing product 9.

The operator instructs to input a measurement point for each color patch. Upon receiving this instruction, the CPU 13A reads, from the compact disk device 13E, the lateral positions x1 to xm of the measurement points at which the color patches of the respective colors in the color bar 9-1 are measured by the spectroscopic sensor 11, and stores them in the memory M7 (step S104).

[Calculation of Lateral Measurement Positions at which Color Bar is Measured by Image Sensor]

When data is input in this way, the CPU 13A calculates the lateral measurement positions at which the color bar 9-1 is measured by the image sensor 12 (step S105).

In calculating the lateral measurement positions for the color bar 9-1, the lateral position x1 of the first color patch measurement point is read out from the memory M7. Also, the distance d between the spectroscopic sensor 11 and the image sensor 12 is read out from the memory M8, and the initial measurement interval L0 for the color bar 9-1 is read out from the memory M9. Then, the distance d between the spectroscopic sensor 11 and the image sensor 12 is subtracted from the lateral position x1 of the first color patch measurement point, and the initial measurement interval L0 for the color bar 9-1 is added to the obtained difference, thereby calculating the lateral position c1 of the first color bar measurement point.

The initial measurement interval L0 for the color bar 9-1 is added to the thus calculated lateral position cl of the first color bar measurement point to calculate the lateral position c2 of the second color bar measurement point. The same process is subsequently repeated until the lateral position c10 of the 10th color bar measurement point is calculated.

The measurement interval L (L>L0) for the color bar 9-1, which is set by the operator, is read out from the memory M2 and added to the lateral position c10 of the 10th color bar measurement point to calculate a lateral position c11 of the 11th color bar measurement point. In the same way, the lateral positions of the measurement points for the color bar 9-1 are calculated until the lateral position xm of the last color patch measurement point is exceeded.

The number of measurement points for the color bar 9-1 immediately before the lateral position xm of the last color patch measurement point is exceeded is determined as the total number Lmax of measurement points for the color bar 9-1, and stored in the memory M10. Also, the lateral positions cl to cLmax of the measurement points for the color bar 9-1 until the total number Lmax of measurement points is reached are stored in the memory M11.

[Generation of Basic Lateral-to-Upward/Downward Scanning Path Conversion Equation]

The CPU 13A generates a basic lateral-to-upward/downward scanning path conversion equation of the color bar 9-1 (step S106). That is, the upward/downward position Yb of the color bar 9-1 is read out from the memory M1 to generate a basic lateral-to-upward/downward scanning path conversion equation assuming that the upward/downward position Yb of the color bar 9-1 is used with respect to all the lateral positions of the measurement points for the color bar 9-1, and the generated conversion equation is stored in the memory M12.

[Rearrangement of Lateral Measurement Positions at which Respective Color Patches are Measured by Spectroscopic Sensor, and those at which Color Bar is Measured by Image Sensor]

The CPU 13A reads out the lateral positions x1 to xm of the measurement points at which the respective color patches are measured by the spectroscopic sensor 11, which are stored in the memory M7, and the lateral positions cl to cLmax of the measurement points at which the color bar 9-1 is measured by the image sensor 12, which are stored in the memory M11. The readout positions of the respective measurement points are rearranged in a specific order (in ascending order) from the left end, and the rearranged positions of the respective measurement points are stored in the memory M13 as the measurement positions of the scanning head 10-3 (step S107). At this time, the number of lateral positions x1 to xm of the measurement points for the respective color patches, and the number of lateral positions c1 to cLmax of the measurement points for the color bar 9-1 are summed up, and the obtained sum is stored in the memory M14 as the total number Dmax of measurement points.

[Measurement of Density Value of Each Color Patch While Adjusting Upward/downward Position]

The CPU 13A reads out the upward/downward position Yb of the color bar 9-1 from the memory M1 to move the scanning head 10-3 to the upward/downward position Yb (step S108). In the initial state, the scanning head 10-3 is located at the origin position in the lateral and upward/downward directions on the base 10-1. The scanning head 10-3 moves from this origin position to the upward/downward position Yb of the color bar 9-1.

This movement of the scanning head 10-3 is done while the rollers 10-31 and 10-32 are floated.

Thus, the scanning head 10-3 quickly moves to the upward/downward position Yb of the color bar 9-1.

After the scanning head 10-3 moves to the upward/downward position Yb of the color bar 9-1, the CPU 13A moves it laterally (step S109). This movement of the scanning head 10-3 is done while the rollers 10-31 and 10-32 are landed on the base 10-1. Thus, the distances between the spectroscopic sensor 11 and image sensor 12 and the printing product 9 on the base 10-1 are stably maintained constant.

In laterally moving the scanning head 10-3, the CPU 13A reads out the basic lateral-to-upward/downward scanning path conversion equation for the color bar 9-1, which is stored in the memory M12, and stores it in the memory M15 as a lateral-to-upward/downward scanning path conversion equation for measurement. The upward/downward position of the scanning head 10-3 is adjusted based on this lateral-to-upward/downward scanning path conversion equation for measurement (step S110).

When the scanning head 10-3 reaches the measurement position stored in the memory M13 (YES in step S111), it is checked whether a specific color patch is to be measured by the spectroscopic sensor 11 at this measurement position (step S112). If a specific color patch is to be measured by the spectroscopic sensor 11 at the reached measurement position (YES in step S112), color data of this color patch is measured by the spectroscopic sensor 11, and the measured color data is stored in the memory M16 in association with this color patch (step S113).

On the other hand, if the color bar 9-1 is to be measured by the image sensor 12 at the reached measurement position, the color bar 9-1 is sensed by the image sensor 12 (step S114). The sensed image data is stored in the memory M17. At this time, if the color bar 9-1 has not yet been sensed by the image sensor 12 ten times or more (NO in step S115), the upward/downward position of the color bar 9-1 is calculated from the sensed image data and stored in the memory M18 (step S116). In this calculation, the lower end position of the sensed color bar 9-1 is added to its upper end position, and the obtained sum is divided by two to obtain the central position of the color bar 9-1 so that the obtained central position is determined as the upward/downward position of the color bar 9-1.

Thus, until the number of times of sensing the color bar 9-1 by the image sensor 12 reaches 10 while laterally moving the scanning head 10-3 (until the image sensor 12 completes measurement of the color bar 9-1 at the initial measurement interval L0), the upward/downward position of the scanning head 10-3 is adjusted based on the basic lateral-to-upward/downward scanning path conversion equation obtained in step S106.

If the color bar 9-1 has already been sensed by the image sensor 12 ten times or more (YES in step S115), the upward/downward position of the color bar 9-1 is calculated from the sensed image data and stored in the memory M18 (step S117). A lateral-to-upward/downward scanning path conversion equation of the color bar 9-1 is obtained again using the least-squares method from the upward/downward position of the color bar 9-1, which is stored in the memory M18, to rewrite the lateral-to-upward/downward scanning path conversion equation for measurement of the color bar 9-1, which is stored in the memory M15 (step S118).

Thus, when the color bar 9-1 has already been sensed by the image sensor 12 ten times or more while laterally moving the scanning head 10-3 (when the image sensor 12 starts measurement of the color bar 9-1 at the measurement interval L (L>L0) set by the operator), a lateral-to-upward/downward scanning path conversion equation of the color bar 9-1 is obtained again using the least-squares method from the previously calculated upward/downward position of the color bar 9-1. The upward/downward position of the scanning head 10-3 is then adjusted based on the lateral-to-upward/downward scanning path conversion equation obtained again.

Figure 13:
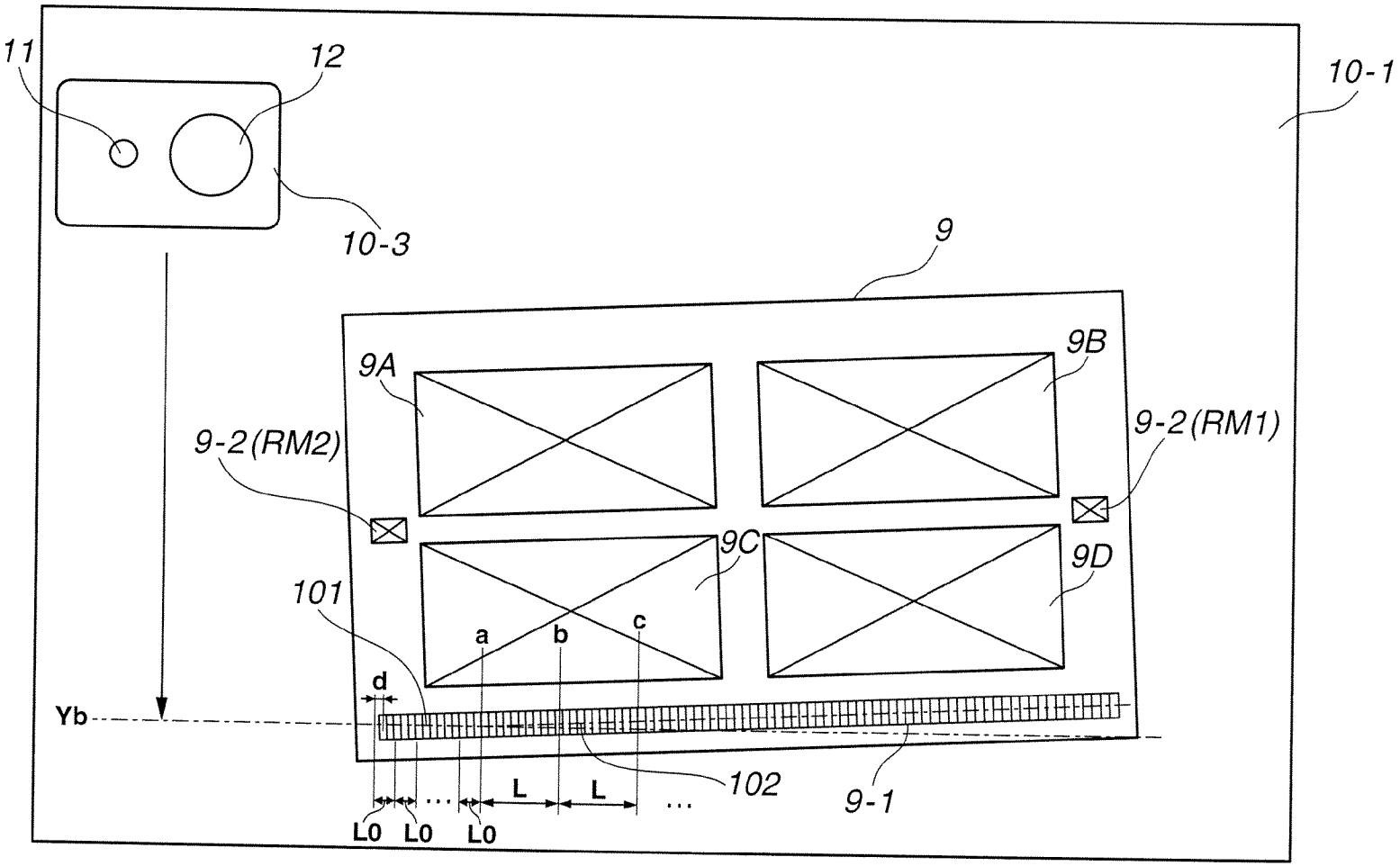
FIG. 13 is a plan view showing the state in which the printing product is placed on the base of the scanner shown in FIG. 4 such that it is shifted with respect to the reference set position.

FIG. 12 illustrates an example in which the printing product 9 is precisely placed at the reference set position on the base 10-1. In contrast, if the printing product 9 is not precisely placed on the base 10-1, the set position of the printing product 9 is shifted with respect to the reference set position. FIG. 13 illustrates an example in which the printing product 9 is placed on the base 10-1 such that it is shifted with respect to the reference set position. As shown in FIG. 13, until the image sensor 12 completes measurement of the color bar 9-1 at the initial measurement interval L0 (point a), the upward/downward position of the scanning head 10-3 is adjusted based on the basic lateral-to-upward/downward scanning path conversion equation (scanning path 101). Next, when the image sensor 12 starts measurement of the color bar 9-1 at the measurement interval L set by the operator, a lateral-to-upward/downward scanning path conversion equation of the color bar 9-1 is obtained again every time a predetermined point (points a, b, c, . . . ) is reached. The upward/downward position of the scanning head 10-3 is adjusted based on the lateral-to-upward/downward scanning path conversion equation obtained again (scanning path 102).

In this manner, when color data of the color patch of each color in the color bar 9-1 is measured by the spectroscopic sensor 11 while moving the scanning head 10-3 in the X direction, the upward/downward position of the scanning head 10-3 is adjusted based on the lateral-to-upward/downward scanning path conversion equation updated at the measurement interval L. This makes it possible to accurately measure color data of the color patch of each color in the color bar 9-1 even if the printing product 9 is placed on the base 10-1 with relatively low precision.

[Sensing of Right and Left Register Marks]

When measurement of the total number Dmax of measurement points is completed (YES in step S119), the CPU 13A reads out the upward/downward and lateral positions of the right register mark RM1 from the memories M5 and M6, respectively. The scanning head 10-3 is moved to the readout upward/downward and lateral positions of the right register mark RM1, and the right register mark RM1 is sensed by the image sensor 12 (step S120). The sensed image data of the right register mark RM1 is stored in the memory M19.

This movement of the scanning head 10-3 to the upward/downward and lateral positions of the right register mark RM1 is quickly done while the rollers 10-31 and 10-32 are floated. After the scanning head 10-3 moves to the upward/downward and lateral positions of the right register mark RM1, the rollers 10-31 and 10-32 land on the base 10-1.

The CPU 13A reads out the upward/downward and lateral positions of the left register mark RM2 from the memories M3 and M4, respectively. The scanning head 10-3 is moved to the readout upward/downward and lateral positions of the left register mark RM2, and the left register mark RM2 is sensed by the image sensor 12 (step S121). The sensed image data of the left register mark RM2 is stored in the memory M20.

This movement of the scanning head 10-3 to the upward/downward and lateral positions of the left register mark RM2 is also quickly done while the rollers 10-31 and 10-32 are floated. After the scanning head 10-3 moves to the upward/downward and lateral positions of the left register mark RM2, the rollers 10-31 and 10-32 land on the base 10-1.

After the right register mark RM1 and left register mark RM2 are measured by the image sensor 12, the CPU 13A returns the scanning head 10-3 to the origin position (step S122). This returning of the scanning head 10-3 to the origin position is also quickly done while the rollers 10-31 and 10-32 are floated.

[Adjustment of Ink Supply Amount of Each Color]

The CPU 13A calculates the measured density value of each color patch from the color data of this color patch, which is measured and stored in the memory M16 (step S123). The measured density value of each color patch is stored in the memory M21.

The CPU 13A reads out the reference density value of each color, which is stored in the memory M22. The density difference between the readout reference density value of each color and the measured density value of the color patch of this color, which is measured in the memory M21, is calculated and stored in the memory M23 (step S124).

The correction value of the opening ratio of the ink fountain key of each color is obtained using the density difference-to-ink fountain key opening ratio correction value conversion table of this color, which is stored in the memory M24, from the calculated density difference of the color patch of this color, thereby modifying the opening ratio of the ink fountain key of this color (step S125). The correction value of the opening ratio of the ink fountain key of each color is stored in the memory M25, and the modified value of the opening ratio of the ink fountain key of this color is stored in the memory M26.

[Registration Adjustment of Each Color]

The CPU 13A obtains the position of the right register mark RM1 of each color from the image data of the right register mark RM1, which is stored in the memory M19 (step S126). The CPU 13A obtains the position of the left register mark RM2 of each color from the image data of the left register mark RM2, which is stored in the memory M20 (step S127).

Next, the registration error amount of each color in the skewing direction is obtained from the upward/downward positions of the right and left register marks 9-2 of this color, and the obtained registration error amounts in the skewing direction are sent to the registration adjusting devices 15-1 to 15-M of the respective colors. The registration adjusting devices 15-1 to 15-M of the respective colors adjust registration of these colors in the skewing direction using the received registration error amounts (step S128).

The position of the right register mark RM1 of each color is corrected using the registration error amount of this color in the skewing direction to obtain the registration error amount of this color in the upward/downward direction from the corrected upward/downward position of the register mark RM1 of this color. The obtained registration error amounts in the upward/downward direction are sent to the registration adjusting devices 15-1 to 15-M of the respective colors to adjust registration of these colors in the upward/downward direction (step S129).

The registration error amount of each color in the lateral direction is obtained from the lateral positions of the right and left register marks 9-2 of this color. The obtained registration error amounts in the lateral direction are sent to the registration adjusting devices 15-1 to 15-M of the respective colors to adjust registration of these colors in the lateral direction (step S130).

[Ink Fountain Key Control Device]

Figure 14:
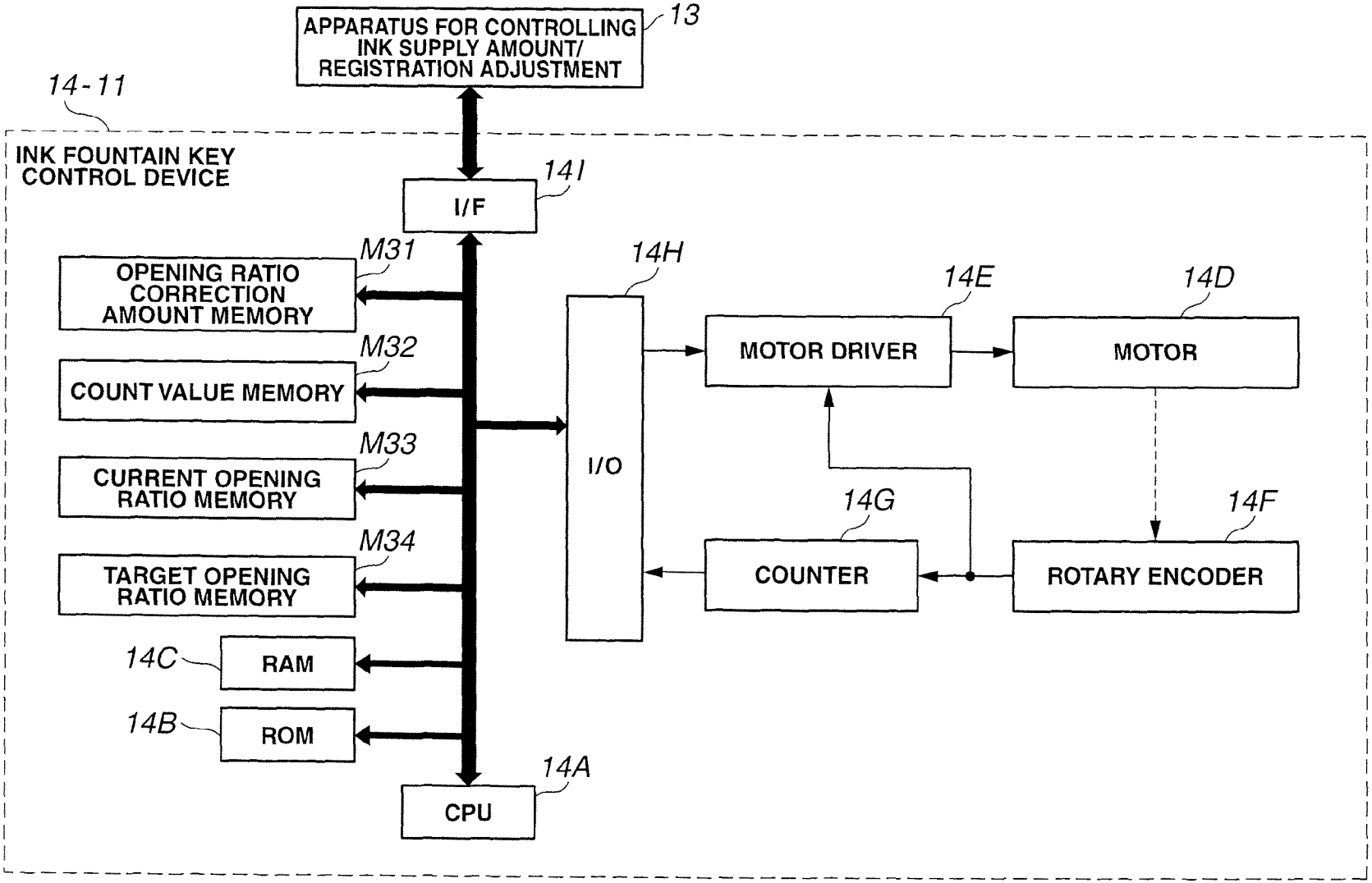
FIG. 14 is a block diagram showing the electrical configuration of an ink fountain key control device connected to the apparatus for controlling ink supply amount/registration adjustment shown in FIG. 9.

The ink fountain key control device 14-11 includes a CPU 14A, a ROM 14B, a RAM 14C, an ink fountain key driving motor 14D, an ink fountain key driving motor driver 14E, a rotary encoder 14F for the ink fountain key driving motor 14D, a counter 14G, input/output interfaces 14H and 14I, and memories M31 to M34, as shown in FIG. 14. The ink fountain key control device 14-11 is connected to the apparatus 13 for controlling ink supply amount/registration adjustment via the interface 14I.

The memory M31 stores the received correction amount of the opening ratio of each ink fountain key. The memory M32 stores the count value of the counter 14G. The memory M33 stores the current opening ratio of each ink fountain key. The memory M34 stores the target opening ratio of each ink fountain key.

Figure 15A:
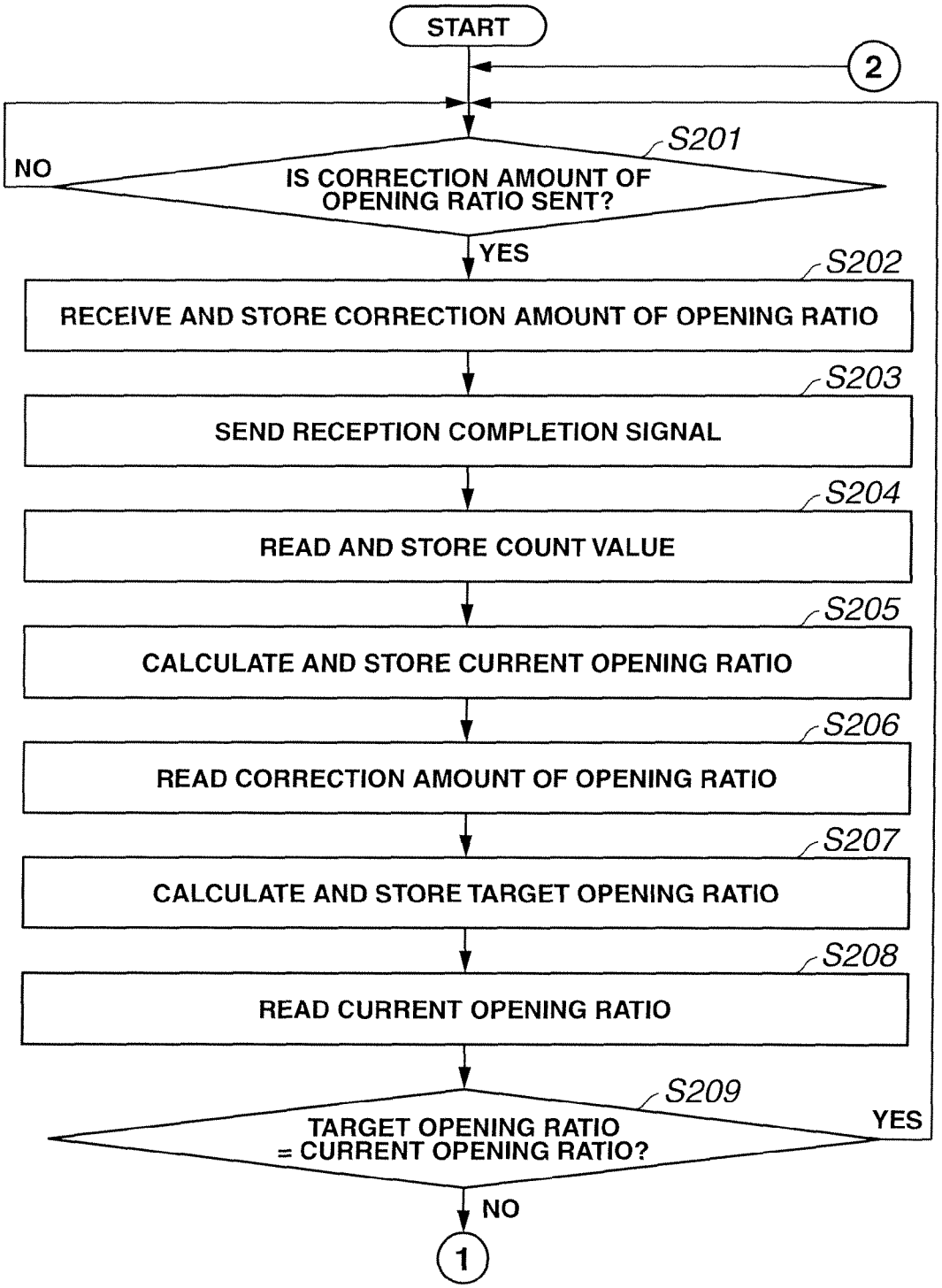
FIGS. 15A and 15B are flowcharts showing an operation of controlling the opening ratio of each ink fountain key by the ink fountain key control device shown in FIG. 14.
Figure 15B:
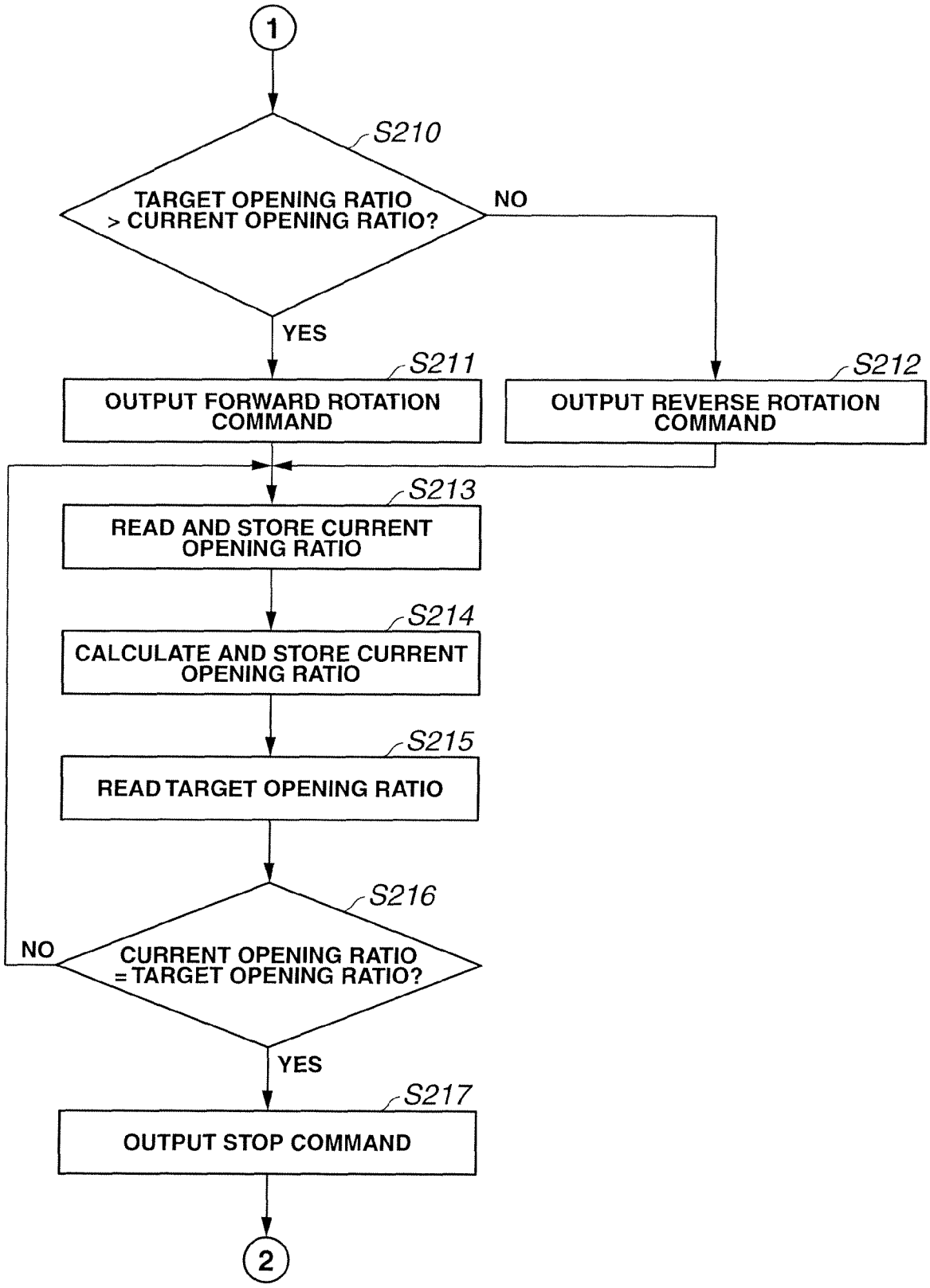

The process operation of the CPU 14A of the ink fountain key control device 14-11 will be described next with reference to FIGS. 15A and 15B.

When the correction amount of the opening ratio of each ink fountain key is sent from the apparatus 13 for controlling ink supply amount/registration adjustment to the ink fountain key control device 14-11 (YES in step S201 of FIG. 15A), the CPU 14A stores the sent correction amount of the opening ratio of this ink fountain key in the memory M31 (step S202).

The CPU 14A sends a reception completion signal of the correction amount of the opening ratio of each ink fountain key to the apparatus 13 for controlling ink supply amount/registration adjustment (step S203). The CPU 14A reads the current count value from the counter 14G, and stores it in the memory M32 (step S204).

The CPU 14A reads out the current count value of the counter 14G from the memory M32. The CPU 14A calculates the current opening ratio of each ink fountain key from the readout count value, and stores it in the memory M33 (step S205).

The CPU 14A reads out the correction amount of the opening ratio of each ink fountain key from the memory M31 (step S206). The CPU 14A adds this correction amount to the current opening ratio of each ink fountain key in the memory M33 to calculate the target opening ratio of this ink fountain key, and stores the obtained target opening ratio in the memory M34 (step S207).

The CPU 14A reads out the current opening ratio of each ink fountain key in the memory M33 (step S208), and compares it with the target opening ratio of this ink fountain key in the memory M34 (step S209). If the target opening ratio and the current opening ratio are not equal (NO in step S209), the CPU 14A confirms whether the current opening ratio is lower or higher than the target opening ratio (step S210).

If the current opening ratio of each ink fountain key is lower than the target opening ratio of this ink fountain key (YES in step S210), the CPU 14A sends a forward rotation command to the motor driver 14E (step S211). On the other hand, if the current opening ratio of each ink fountain key is higher than the target opening ratio of this ink fountain key (NO in step S210), the CPU 14A sends a reverse rotation command to the motor driver 14E (step S212).

The CPU 14A reads the current count value of the counter 14G (step S213) to calculate the current opening ratio of each ink fountain key using the read count value (step S214). The CPU 14A reads out the target opening ratio of each ink fountain key from the memory M34 (step S215), and repeats a series of process operations in steps S213 to S216 until the current opening ratio of each ink fountain key and the target opening ratio of this ink fountain key become equal (YES in step S216).

If the current opening ratio of each ink fountain key and the target opening ratio of this ink fountain key are equal (YES in step S216), the CPU 14A outputs a stop command to the motor driver 14E to stop the rotation of the motor 14D.

[Registration Adjusting Device]

Figure 16:
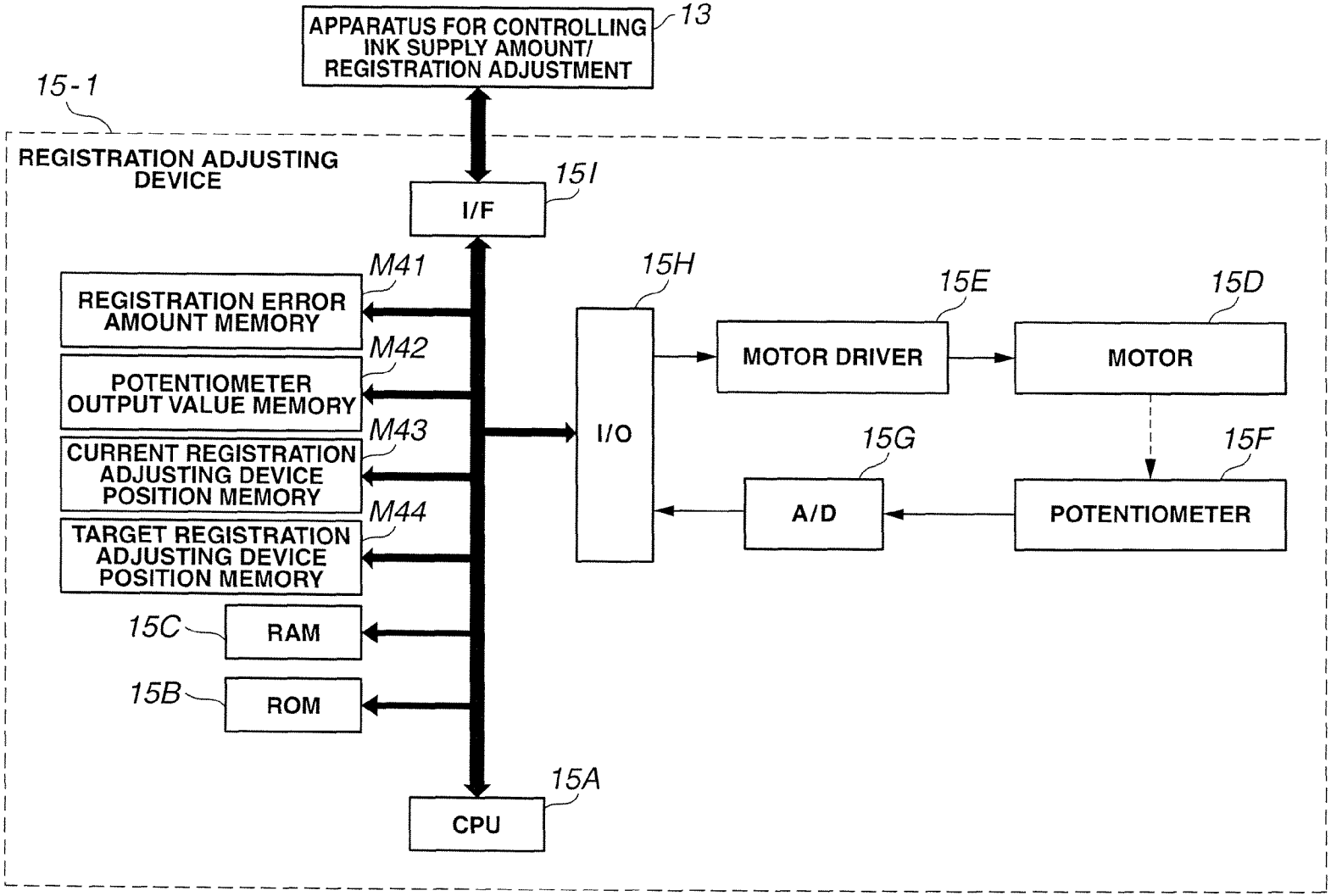
FIG. 16 is a block diagram showing the electrical configuration of a registration adjusting device connected to the apparatus for controlling ink supply amount/registration adjustment shown in FIG. 9.

The registration adjusting device 15-1 includes a CPU 15A, a ROM 15B, a RAM 15C, a registration adjusting motor 15D, a registration adjusting motor driver 15E, a potentiometer 15F for the registration adjusting motor 15D, an A/D converter 15G, input/output interfaces (I/O, I/F) 15H and 15I, and memories M41 to M44, as shown in FIG. 16. The registration adjusting device 15-1 is connected to the apparatus 13 for controlling ink supply amount/registration adjustment via the interface 15I.

The memory M41 stores the received registration error amount. The memory M42 stores the output value of the potentiometer 15F for the registration adjusting motor 15D. The memory M43 stores the current position of the registration adjusting device 15-1. The memory M44 stores the target position of the registration adjusting device 15-1.

Note that three registration adjusting devices for the skewing, circumferential, and lateral directions, which constitute the registration adjusting device 15-1, have the same configuration. Hence, FIG. 13 assumes that the registration adjusting device 15-1 is a registration adjusting device which performs registration adjustment in one direction. Note that registration adjusting devices for the skewing, circumferential, and lateral directions for each color may be provided as independent devices.

Figure 17A:
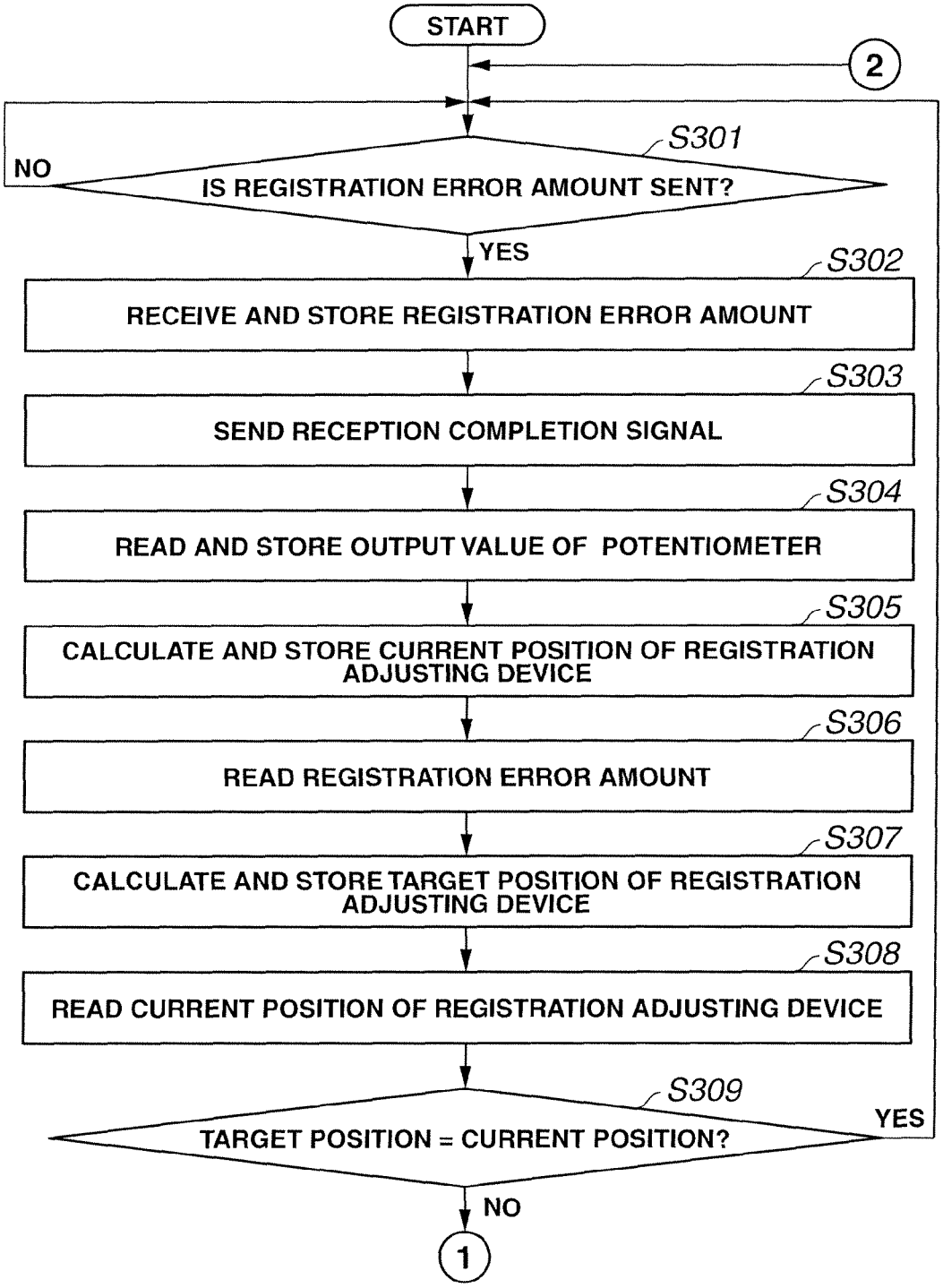
FIGS. 17A and 17B are flowcharts showing a registration adjustment operation by the registration adjusting device shown in FIG. 16.
Figure 17B:
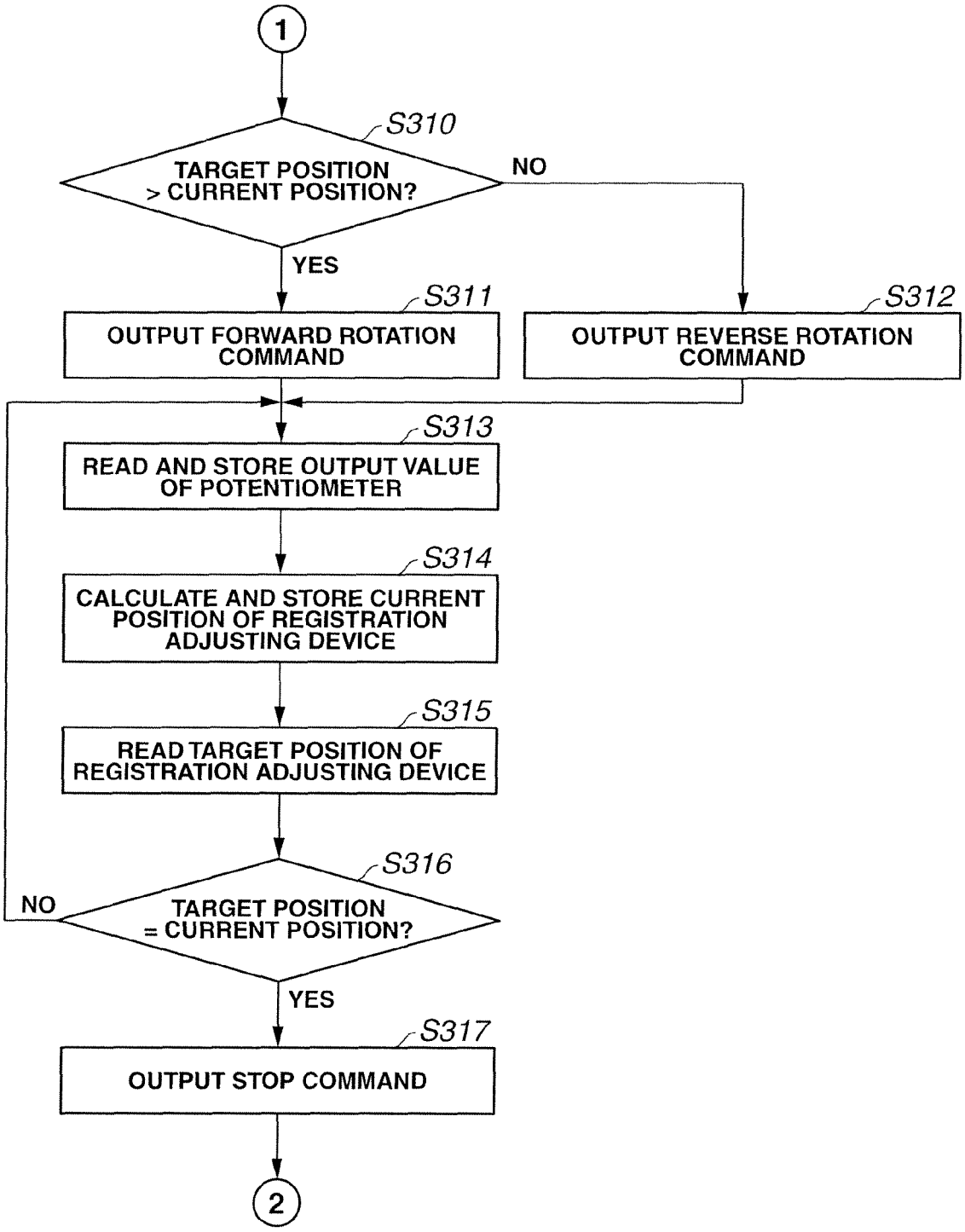

When the registration error amount is sent from the apparatus 13 for controlling ink supply amount/registration adjustment (YES in step S201 of FIG. 17A), the CPU 15A stores the sent registration error amount in the memory M41 (step S302). The CPU 15A sends a reception completion signal of the registration error amount to the apparatus 13 for controlling ink supply amount/registration adjustment (step S303). The CPU 15A reads the current output value from the potentiometer 15F via the A/D converter 15G, and stores it in the memory M42 (step S304).

The CPU 15A reads out the current output value of the potentiometer 15F from the memory M42 to calculate the current position of the registration adjusting device using the readout output value, and stores the obtained current position in the memory M43 (step S305).

The CPU 15A reads out the registration error amount from the memory M41 (step S306). The CPU 15A adds this registration error amount to the current position of the registration adjusting device in the memory M43 to calculate the target position of the registration adjusting device, and stores the obtained target position in the memory M44 (step S307).

The CPU 15A reads out the current position of the registration adjusting device in the memory M43 (step S308), and compares it with the target position of the registration adjusting device in the memory M44 (step S309). If the target position and the current position are not equal (NO in step S309), the CPU 15A confirms whether the current position is lower or higher than the target position (step S310).

If the current position is lower than the target position (YES in step S310), the CPU 15A sends a forward rotation command to the motor driver 15E (step S311). If the current position is higher than the target position (NO in step S310), the CPU 15A sends a reverse rotation command to the motor driver 15E (step S312).

The CPU 15A reads the current output value from the potentiometer 15F via the A/D converter 15G (step S313) to calculate the current position of the registration adjusting device from the read output value (step S314). The CPU 15A reads out the target position of the registration adjusting device from the memory M44 (step S315), and repeats a series of process operations in steps S313 to S316 until the current position and the target position become equal (YES in step S316).

If the current position and the target position are equal (YES in step S316), the CPU 15A outputs a stop command to the motor driver 15E to stop the rotation of the motor 15D (step S317).

In this embodiment, a detector which measures color data of the color patch of each color in the color bar 9-1 is used as the spectroscopic sensor 11, a detector which detects the position of the register mark of each color is used as the image sensor 12, and the image sensor 12 is mounted on the scanning head 10-3, together with the spectroscopic sensor 11, so as to also serve as a detector which detects the upward/downward position of the color bar 9-1. This makes it possible to integrate a camera required to adjust registration, and a line sensor required to detect the upward/downward position of the color bar. This, in turn, makes it possible to improve the cost performance, and simplify maintenance so as to relieve the operator's burden.

Although the density value (measured density value) of the color patch of each color is obtained from the color data of this color patch, which is measured by the spectroscopic sensor 11, in the above-described embodiment, the color value of this color patch may be obtained. To obtain the color value of the color patch of each color, the obtained color value (measured color value) is compared with a reference color value to adjust the opening ratio of the ink fountain key of each color in accordance with the color difference between these color values. In addition, the color data need not always be measured using the spectroscopic sensor 11, and the density value may directly be measured using a densitometer which employs a filter.

Also, although register marks printed in a spot pattern are used as the register marks 9-2 in the above-described embodiment, cruciform register marks may be used, as a matter of course.

Moreover, although not described in the above-mentioned embodiment, when images of the register marks 9-2 are to be obtained in practice, the full images of the register marks 9-2 are read by the image sensor 12. On the other hand, when the upward/downward position of the color bar 9-1 is to be detected in practice, the image of the color bar 9-1 is laterally compressed to reduce the image data. This allows a high-speed process.

As has been described above, according to the present invention, since one image sensing means is used for both registration adjustment and detection of the upward/downward position of the color bar, it is possible to reduce the cost and facilitate the maintenance operation by the operator.

What is claimed is:

1. An apparatus for controlling ink supply amount/registration adjustment in a printing press, including a base on which a printing product printed by the printing press is set, a sensor head, sensor head moving means for moving the sensor head laterally and upward/downward on the base, a first detector which is mounted on the sensor head, and measures color matching data of a color patch of each color in a color bar printed in a margin of the printing product, a second detector which detects a position of a register mark of each color, which is printed in a margin of the printing product, and control means for, when the sensor head moves laterally, controlling an ink supply amount of each color in the printing press based on the color matching data of the color patch of each color in the color bar, which is measured by the first detector, and adjusting registration of each color in the printing press based on the position of the register mark of each color, which is measured by the second detector, the sensor head moving means comprising upward/downward position adjusting means for adjusting a upward/downward position of the sensor head, wherein the second detector detects a upward/downward position of the color bar when the color matching data of the color patch of each color in the color bar is measured by the first detector, and said upward/downward position adjusting means adjusts the upward/downward position of the sensor head based on the upward/downward position of the color bar, which is detected by the second detector.

2. An apparatus according to claim 1, wherein the second detector is mounted on the sensor head with a predetermined spacing from the first detector so that the second detector is located downstream of the first detector in a measuring direction.

3. An apparatus according to claim 1, wherein the first detector includes a spectroscopic sensor, and the second detector includes an image sensor.

4. An apparatus according to claim 3, wherein the image sensor has an image sensing region with a upward/downward dimension larger than a width of the color bar.

5. An apparatus according to claim 1, wherein said upward/downward position adjusting means adjusts the upward/downward position of the sensor head based on a basic lateral-to-upward/downward scanning path conversion equation when the color bar is measured by the second detector at an initial measurement interval, and adjusts the upward/downward position of the sensor head based on an obtained lateral-to-upward/downward scanning path conversion equation when the color bar is measured by the second detector at a set measurement interval subsequent to the initial measurement interval.

6. An apparatus according to claim 5, wherein said upward/downward position adjusting means adjusts the upward/downward position of the sensor head based on a lateral-to-upward/downward scanning path conversion equation, which is obtained at a predetermined interval, when the color bar is measured by the second detector at the set measurement interval.

7. A method of controlling ink supply amount/registration adjustment in a printing press, comprising the steps of:

measuring color matching data of a color patch of each color in a color bar, which is printed in a margin of a printing product, using a first detector mounted on a sensor head;

detecting a upward/downward position of the color bar using a second detector upon when the color matching data of the color patch of each color in the color bar is measured by the first detector;

adjusting a upward/downward position of the sensor head based on the upward/downward position of the color bar, which is detected by the second detector;

controlling an ink supply amount of each color in the printing press based on the color matching data of the color patch of each color in the color bar, which is measured by the first detector, when the sensor head moves laterally;

detecting a position of a register mark of each color, which is printed in a margin of the printing product, using the second detector; and adjusting registration of each color in the printing press based on the position of the register mark of each color, which is measured by the second detector.

8. A method according to claim 7, wherein the second detector is mounted on the sensor head with a predetermined spacing from the first detector so that the second detector is located downstream of the first detector in the measuring direction.

9. A method according to claim 7, wherein the first detector includes a spectroscopic sensor, and the second detector includes an image sensor.

10. A method according to claim 9, wherein the image sensor has an image sensing region with a upward/downward dimension larger than a width of the color bar.

11. A method according to claim 7, wherein the step of adjusting the upward/downward position of the sensor head using the second detector comprises the steps of adjusting the upward/downward position of the sensor head based on a basic lateral-to-upward/downward scanning path conversion equation when the color bar is measured by the second detector at an initial measurement interval, and adjusting the upward/downward position of the sensor head based on an obtained lateral-to-upward/downward scanning path conversion equation when the color bar is measured by the second detector at a set measurement interval subsequent to the initial measurement interval.

12. A method according to claim 11, wherein the step of adjusting the upward/downward position of the sensor head at the set measurement interval comprises the step of adjusting the upward/downward position of the sensor head based on a lateral-to-upward/downward scanning path conversion equation obtained at a predetermined interval.

* * * * *